US005149912A

United States Patent [19]

Waidner et al.

[11] Patent Number: 5,149,912

[45] Date of Patent: Sep. 22, 1992

[54] METHOD AND APPARATUS FOR ASSEMBLING A FUSEE AND WIRE SUPPORT STAND

[75] Inventors: Robert A. Waidner, Baltimore; John J. Brady, Easton, both of Md.

[73] Assignee: Standard Fusee Corporation, Easton, Md.

[21] Appl. No.: 75,687

[22] Filed: Jul. 20, 1987

[51] Int. Cl.[5] ..... F42B 4/26

[52] U.S. Cl. ..... 102/343; 102/344; 102/351; 102/357

[58] Field of Search ..... 102/343, 344, 351, 357

[56] References Cited

U.S. PATENT DOCUMENTS

| | | | |
|---|---|---|---|
| 1,776,354 | 9/1930 | Edmands | 102/37.4 X |
| 2,005,826 | 6/1935 | Kulp et al. | 298/44 |
| 2,090,911 | 8/1937 | Frizzell et al. | 102/24 |
| 2,306,442 | 12/1942 | Holmes | 102/36 |
| 2,319,969 | 5/1943 | Besemer | 216/55 |
| 2,324,925 | 7/1943 | Hallowell, Jr. | 86/1 |
| 2,356,806 | 8/1944 | Woodberry et al. | 86/45 |
| 2,467,918 | 4/1949 | Slater | 102/37.4 |
| 2,824,482 | 2/1958 | North | 86/1 |
| 3,179,108 | 4/1965 | Bloch et al. | 128/269 |
| 3,187,361 | 6/1965 | Wheeler | 15/88 |
| 3,187,418 | 6/1965 | Kent | 29/203 |
| 3,188,674 | 6/1965 | Hobbs | 15/179 |
| 3,285,550 | 11/1966 | Smith | 248/46 |
| 3,418,358 | 12/1968 | Sejda | 156/468 |
| 3,524,409 | 8/1970 | Griffith | 102/37.4 |
| 3,625,799 | 12/1971 | Way | 156/530 |
| 3,649,413 | 3/1972 | Way | 156/518 |
| 3,673,043 | 6/1972 | Carter | 156/363 |
| 3,678,856 | 7/1972 | Barocca et al. | 102/37.4 |
| 3,901,152 | 8/1975 | Alexander | 102/37.8 |
| 4,046,075 | 9/1977 | Spangler | 102/37.8 |
| 4,264,398 | 4/1981 | Pruitt | 156/468 |
| 4,380,957 | 4/1983 | Makainai, Jr. | 102/202.1 |
| 4,460,024 | 7/1984 | Erhardt | 140/93 R |
| 4,473,429 | 9/1984 | Crankshaw | 156/483 |
| 4,548,022 | 10/1985 | Yaklin | 53/415 |

*Primary Examiner*—Peter A. Nelson
*Attorney, Agent, or Firm*—Nixon & Vanderhye

[57] ABSTRACT

Method and apparatus for automatically attaching a substantially U-shaped support stand to a fusee includes an annular indexable turntable provided with holders for receiving support stands at one workstation, and fusees in assembled relationship with the support stands at another workstation. The support stands are deformed from substantially straight shapes to substantially U-shapes as they are loaded into the holders on the turntable. The free ends of the support stand are subsequently inwardly curled prior to assembly with the fusees. The fusees are fed from a supply hopper, cleaned, and successively inserted into a holder on the turntable in assembled relationship with successively presented support stands.

Subsequently, the turntable is indexed to additional workstations where predetermined lengths of polyfilament tape are successively applied to end portions of the fusees, and subsequently wrapped about the fusees and associated end portions of the support stand to securely join one to the other. At a final workstation, assembled fusees and support stands are successively removed and loaded onto a conveyor in groups which are thereafter successively off-loaded into boxes at a packaging station.

15 Claims, 32 Drawing Sheets

FIG. 1
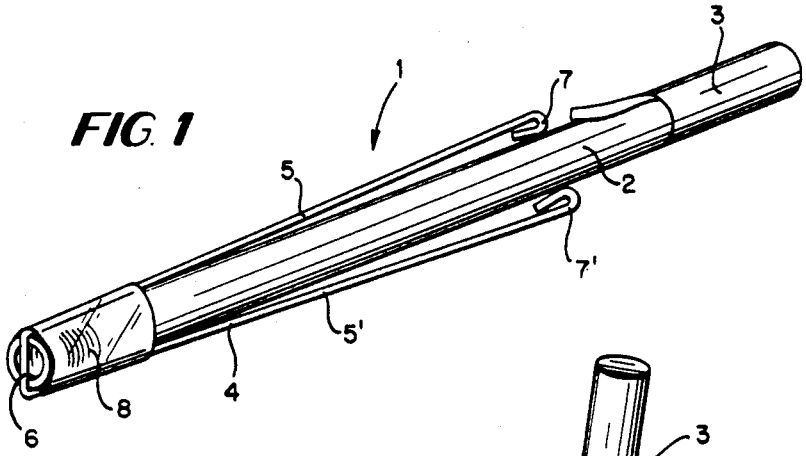
FIG. 2
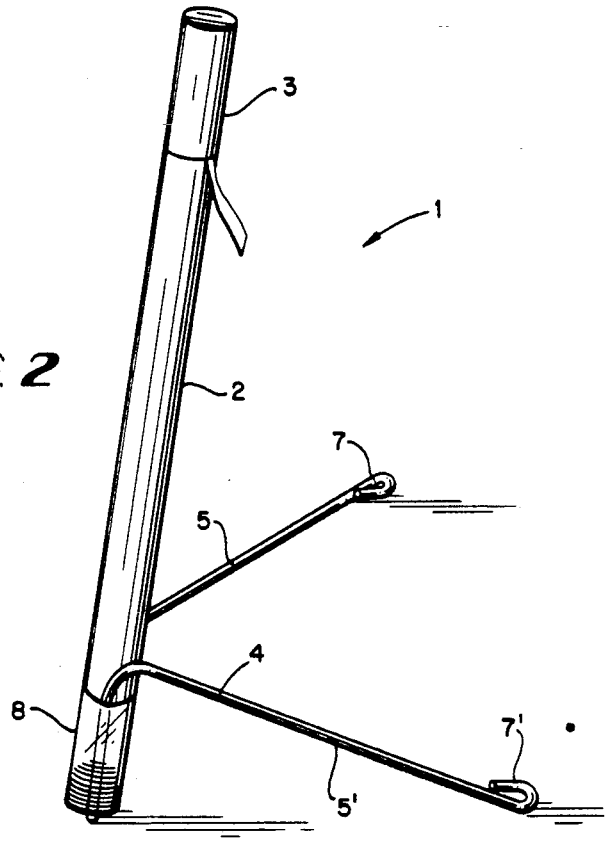
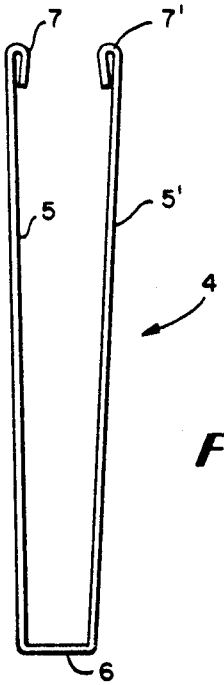
FIG. 3

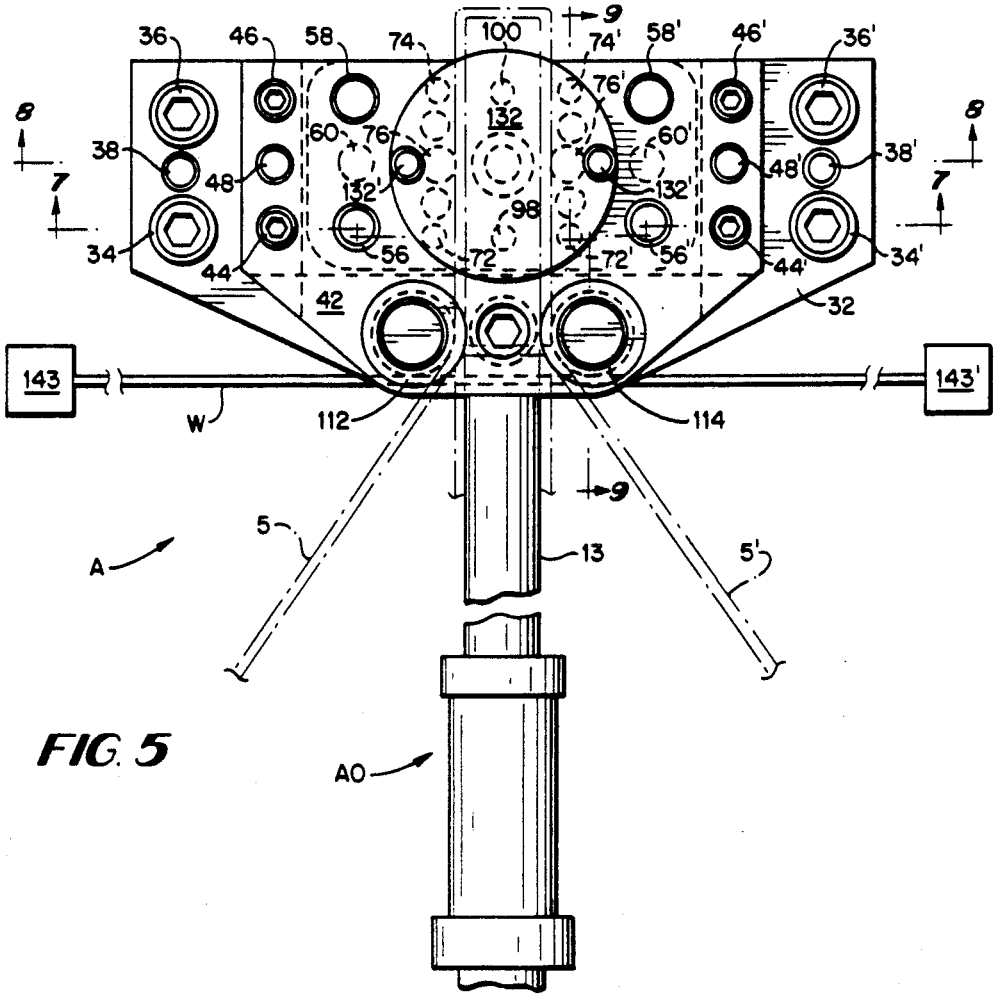
FIG. 5
FIG. 6
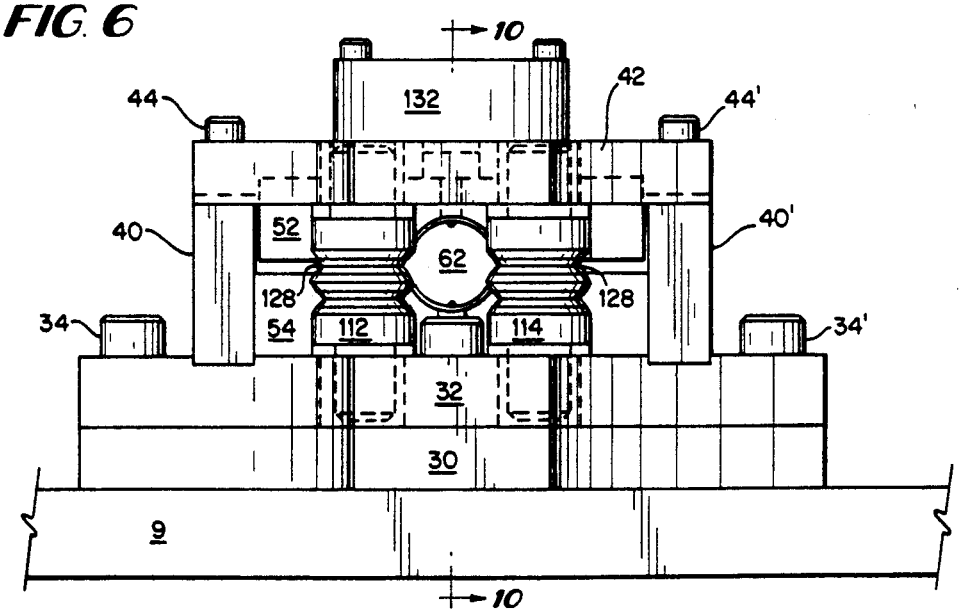

FIG. 7
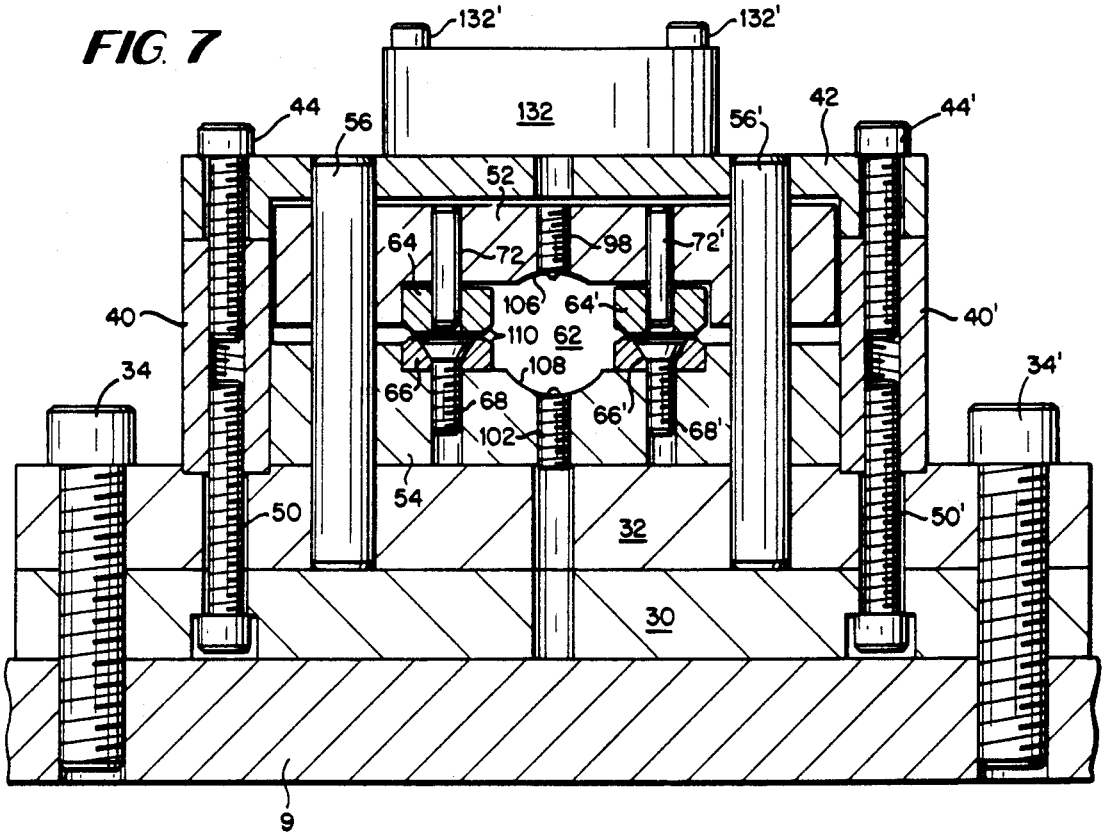
FIG. 9A
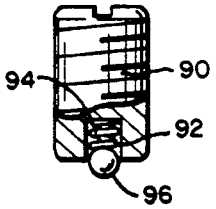
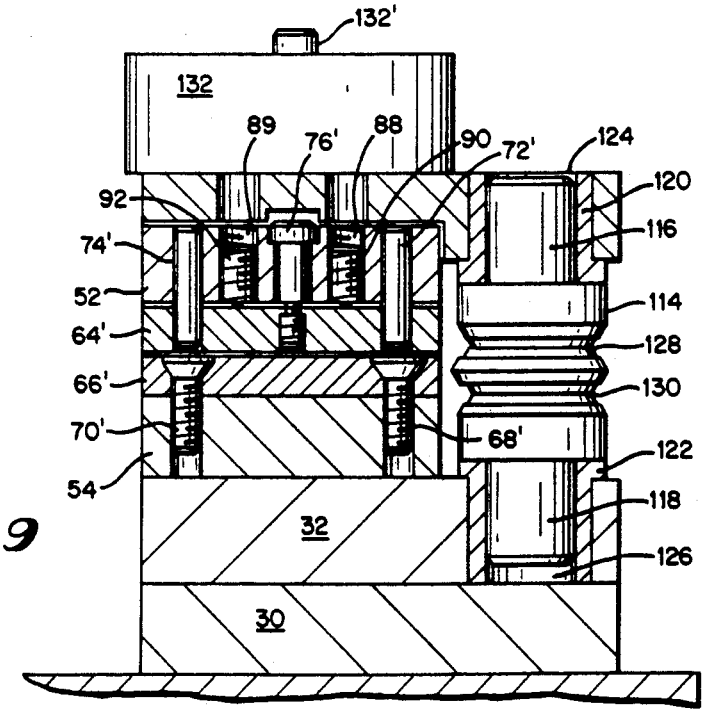
FIG. 9

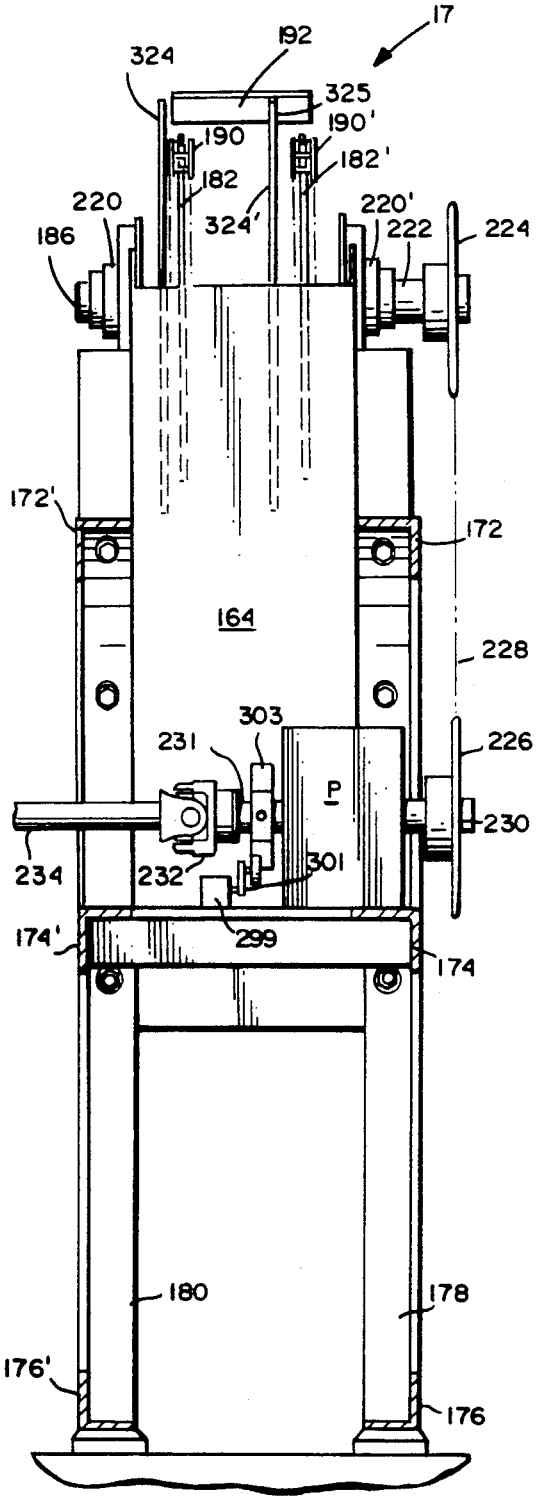
FIG. 14
FIG. 15
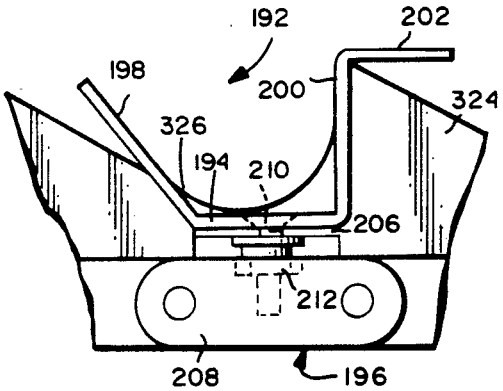
FIG. 16
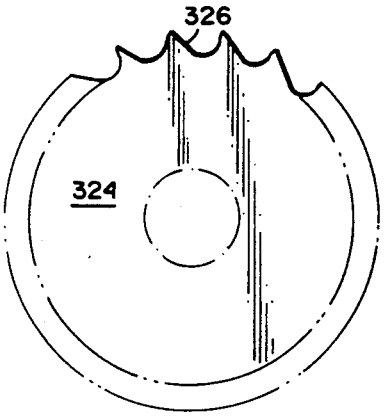

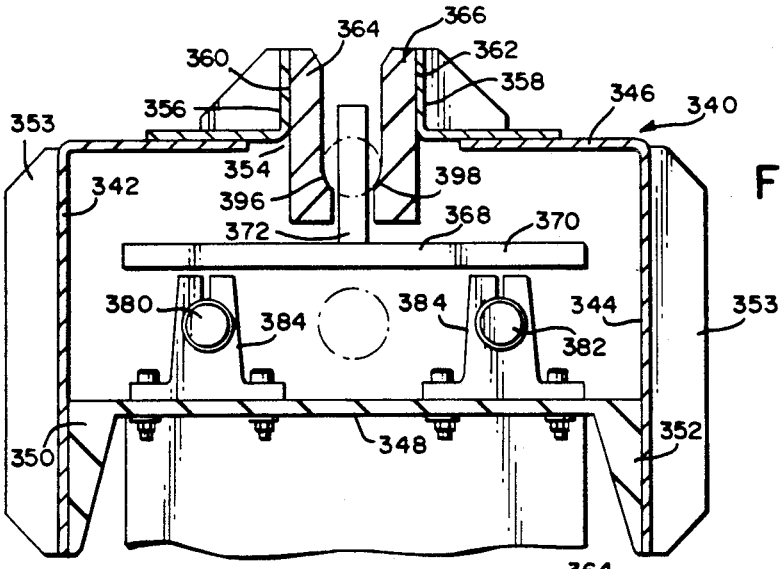
FIG. 23
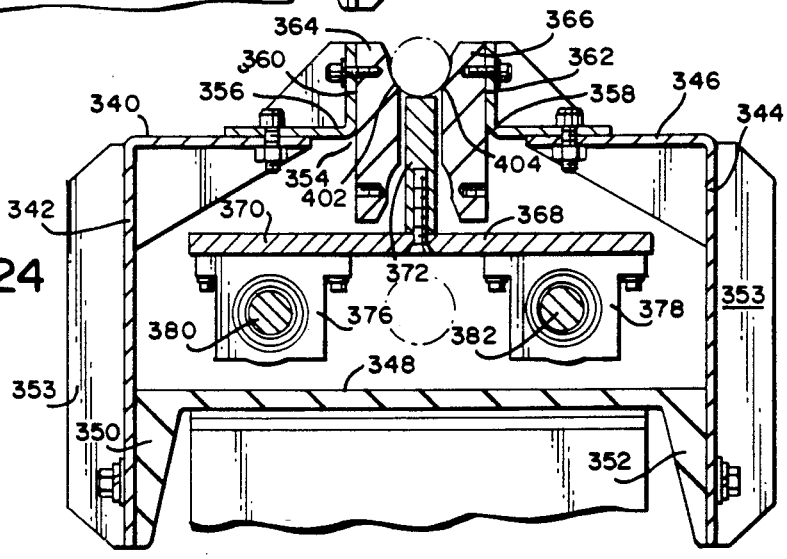
FIG. 24
FIG. 25
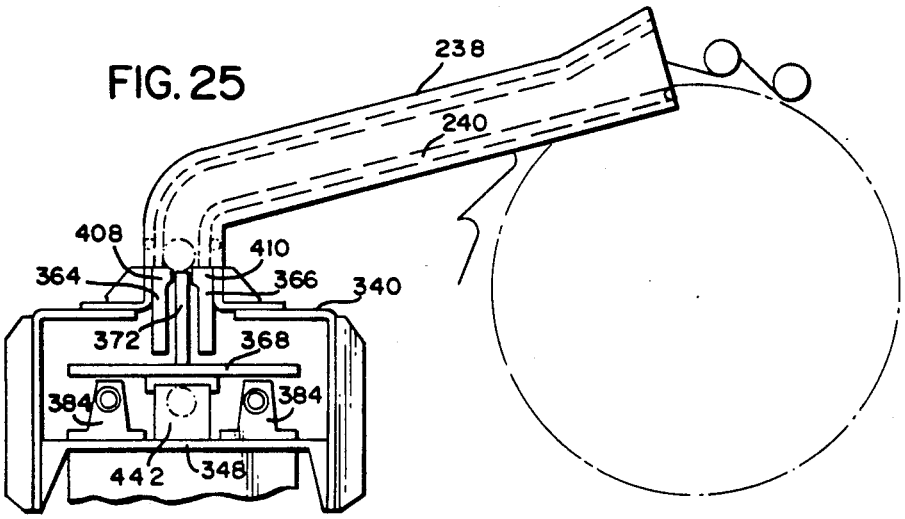

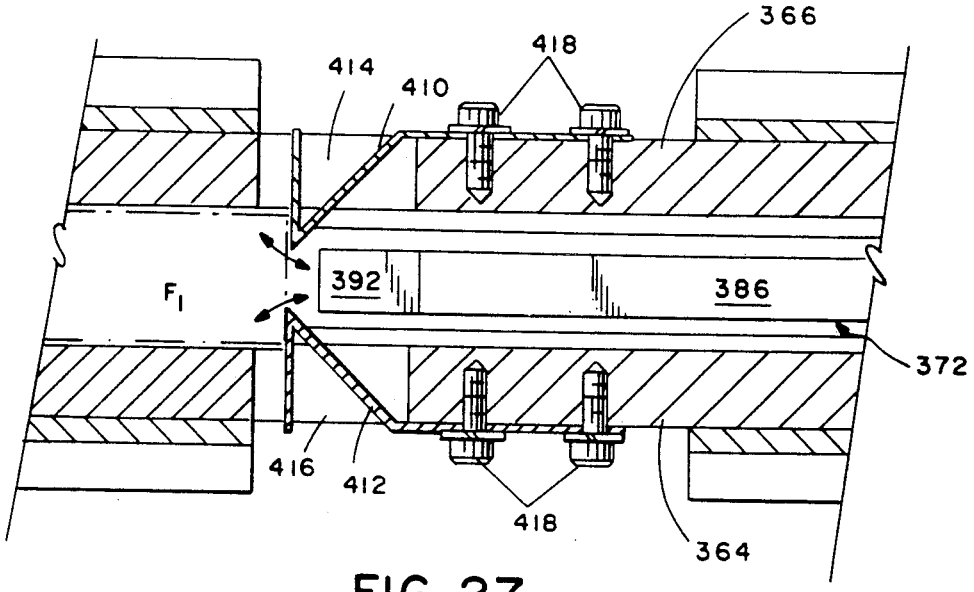
FIG. 27
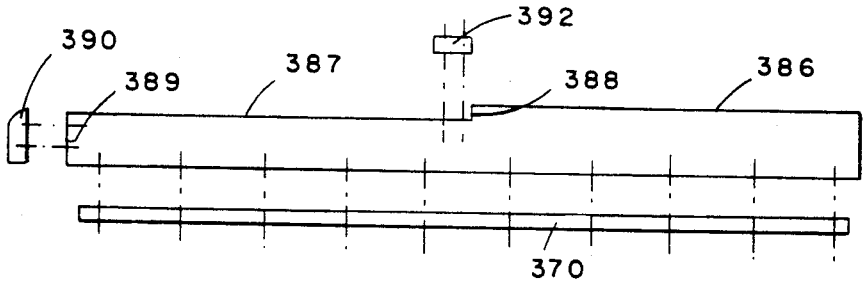
FIG. 28
FIG. 33A FIG. 33B FIG. 33C
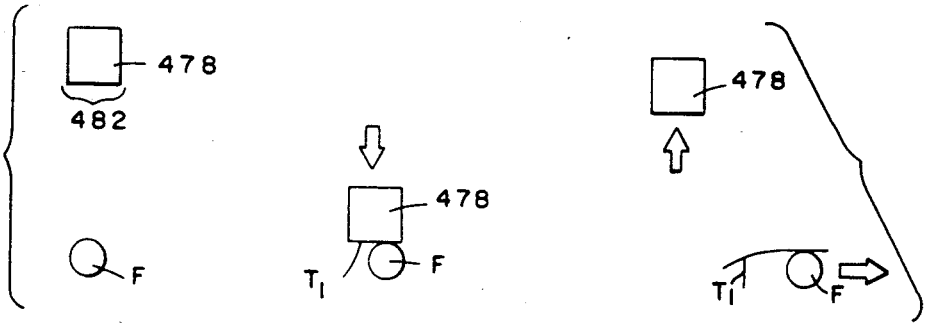

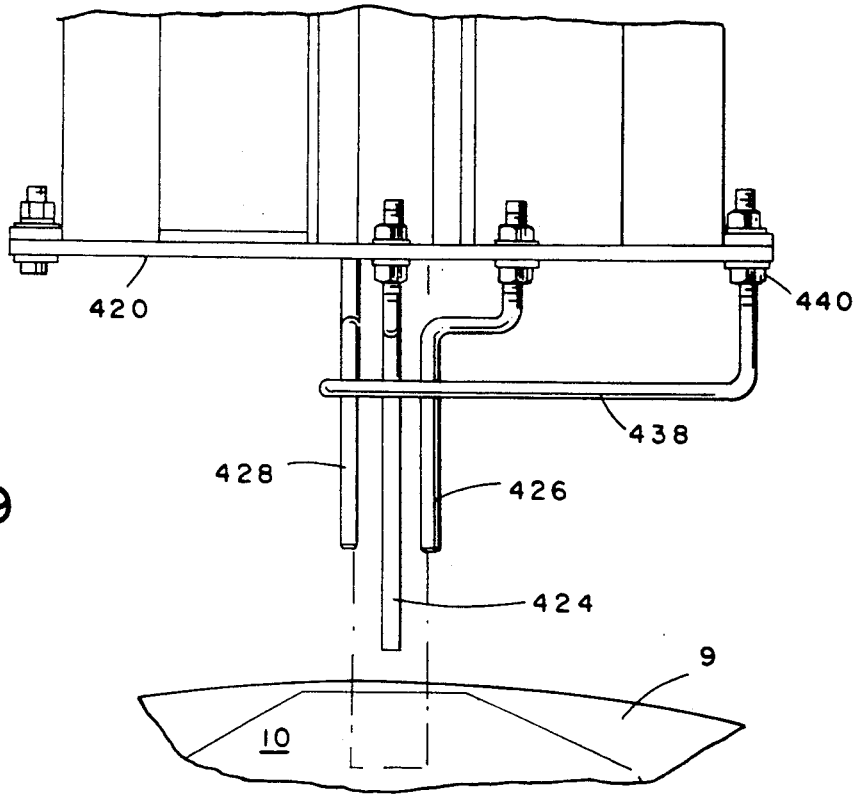
FIG. 29
FIG. 30
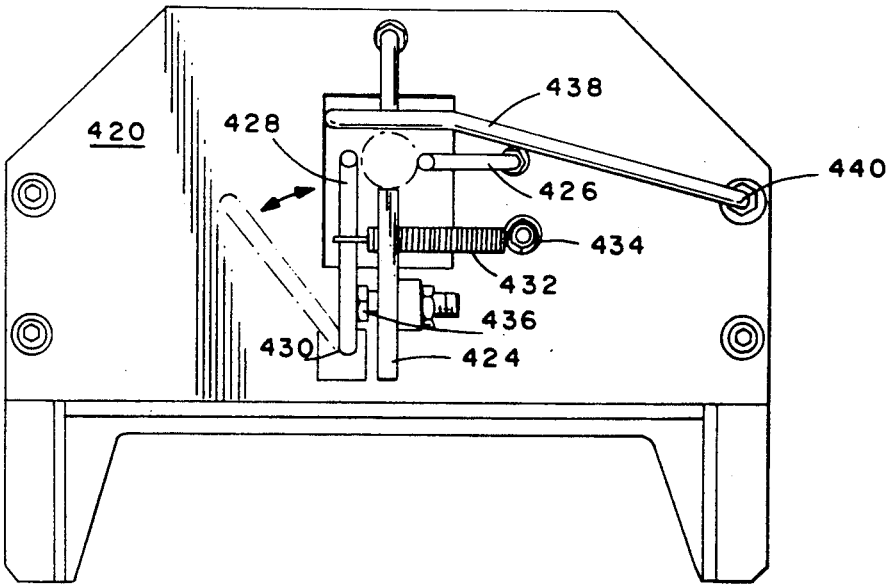

FIG. 31
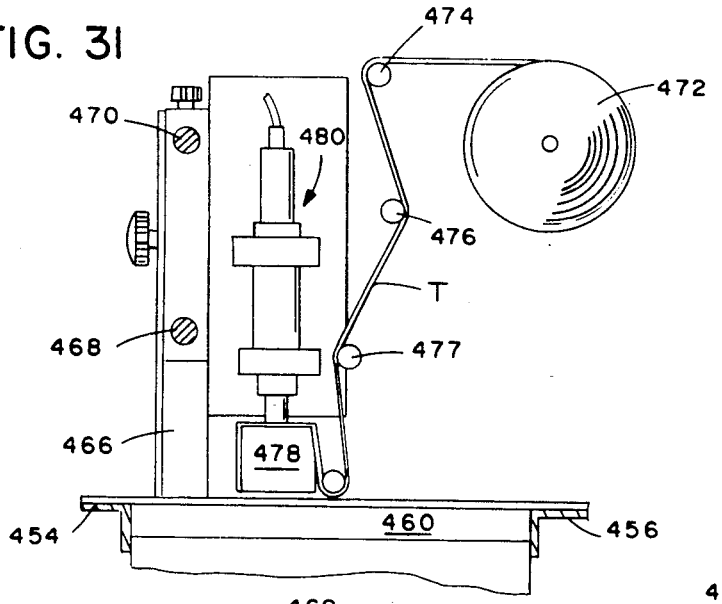
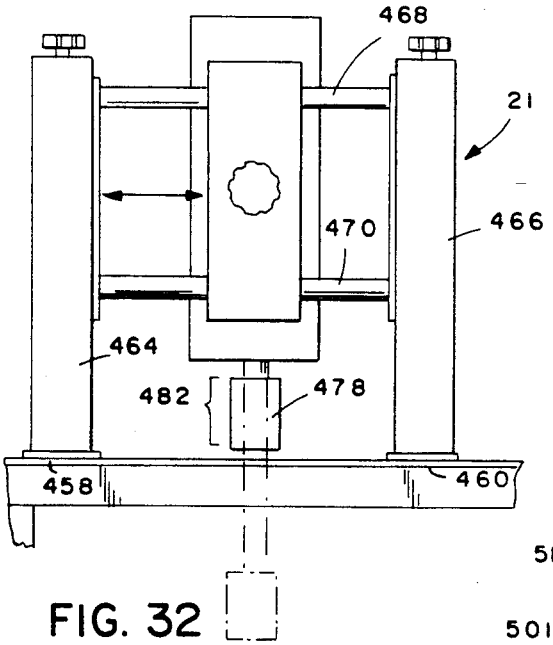
FIG. 32
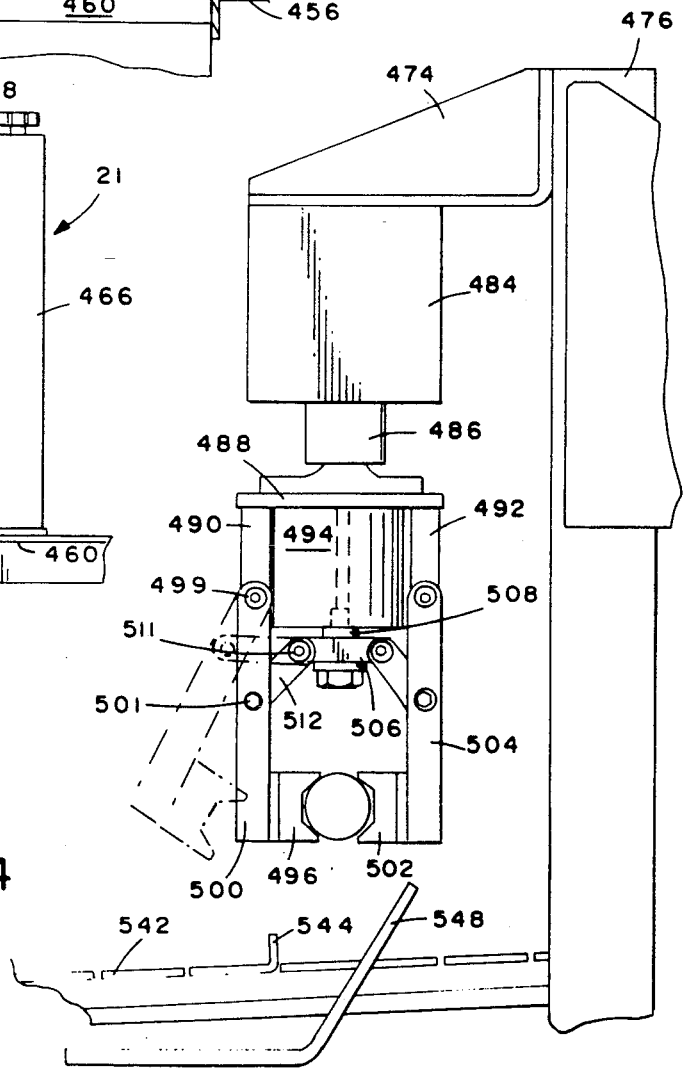
FIG. 44

METHOD AND APPARATUS FOR ASSEMBLING A FUSEE AND WIRE SUPPORT STAND

BACKGROUND AND SUMMARY OF THE INVENTION

This invention relates to road flares, or fusees, and, particularly, to a method and apparatus for assembling a substantially U-shaped wire support stand to an otherwise completed fusee device.

Road flares, or fusees, are commonly utilized to provide a danger or warning signal in the event of a collision, breakdown, or any of a variety of emergency situations which might be encountered on highways, railroads, and the like. To be most effective, a support stand is usually supplied by which at least the ignition end of the fusee may be raised above the road or other surface. The support stand serves the dual purpose of enabling the fusee to be seen more easily from greater distances, and of separating the lighted end of the fusee from water, oil and other undesirable substances which may be present on the road surface.

It is, of course, well known to provide fusees with supporting devices for raising the ignition ends away from the road surface. In U.S. Pat. Nos. 3,678,856 and 3,285,550, paperboard supports are disclosed for attachment to one end of a fusee. Various configurations of wire supports are also known, as exemplified by U.S. Pat. Nos. 2,467,918; 2,306,442; 2,005,826 and 1,776,354.

Substantially U-shaped wire support stands, telescoped over one end of cylindrical fusees, are also known. See for example, U.S. Pat. Nos. 3,524,409 and 2,090,911. As best seen in the latter patent, a U-shaped wire device is applied to the base or rearward end of a fusee (that end opposite the ignition end) with parallel leg portions initially extending along the body of the fusee. A sleeve-like cap is telescoped over the end of the fusee and base portion of the wire support stand, and glued in place so as to attach the support to the body of the fusee. In use, the legs are bent downwardly and outwardly about the forward edge of the cap so that, in conjunction with the base of the fusee, three-point supporting contact is established with the ground or other surface. It is often the case with this type of prior art construction, however, that as the bending force is applied, the wire legs rupture the cap or sleeve, which is typically constructed of lightweight paperboard. Once the cap or sleeve is torn, there is nothing to hold the wire support stand to the fusee and the stand is therefore rendered useless. Absent a support stand, the fusee must be laid flat on the ground where poor performance can result from contact with surface water and the like. In addition, safety hazards may be created where oil or other flammable liquids are also present on the road or other surface.

Manufacture and assembly of fusees and wire support stands typically has been a very labor intensive and therefore costly process. For example, in the assembly area alone, the wire support stand, the cap or sleeve, and a suitable adhesive are normally applied to the body of each fusee manually, one at a time.

Accordingly, it is the general object of this invention to provide a fusee and wire support stand assembly wherein the support stand may be deployed to its operative position without experiencing failure of the means by which the stand is secured to the fusee. More specifically, it is the principal object of the invention to provide a method and apparatus for automatically effecting secure and reliable assembly of wire support stands to fusees.

In the present invention, a high strength tape is wrapped about the rearward end of the fusee and a corresponding end portion of the support stand to securely attach one to the other. The preferred tape according to this invention is of the type generally referred to as polyfilament tape. This has proven to be far superior to the conventional paperboard sleeve used to fasten support stands to fusees, particularly insofar as it provides great resistance against tearing in a direction perpendicular to the length of the tape. This feature allows outward bending of the legs of the wire support stand to virtually any position without rupture of the tape.

To this end, the present invention utilizes an automatically indexable, annular turntable provided with a plurality of fusee, or workpiece, holding devices, evenly spaced about the outer peripheral surface of the turntable for indexing fusees, successively to a plurality of workstations. For convenience, the following general description of the apparatus is provided in terms of the assembly of a single support stand to a single fusee, it being understood that the apparatus is capable of processing a number of fusees continuously in sequence.

At a first workstation located adjacent the turntable, wire from a supply coil is fed through a conventional straightening and cutting device, and is thereafter positioned in the form of a straight strip of wire of predetermined length across the front face of one of the holding devices mounted on the turntable. The wire is releasably held in this position as a hydraulic plunger is actuated to exert pressure on a center portion of the wire strip, pushing the latter transversely into an opening in the front face of the holding device and, in so doing, simultaneously forming the wire into a generally U-shaped fusee support stand, with leg portions extending outwardly from the holding device in a direction radially away from the turntable.

After receiving the wire support stand in an associated holding device, the turntable is indexed to the next station where one of the legs of the U-shaped support stand has its outermost or free end curled inwardly to eliminate any sharp edge which might have resulted from the cutting of the wire. The stand is subsequently indexed to the next station where the other of the leg ends is curled inwardly in the same manner.

Thereafter, the turntable is indexed to an insertion station where a fusee is pushed into the holding device, between the legs of the wire support stand, and into a position where the fusee and the wire support stand are in assembled, but not secured, relationship with respect to one another.

At the same time, fusees are fed to the insertion station from a supply hopper by an inclined conveyor. Just prior to the point where the inclined conveyor loads individual fusees into an insertion mechanism, the conveyor is temporarily halted at a fusee cleaning station. Here, a hydraulically actuated gripper device located adjacent the conveyor pushes a fusee in a direction generally transverse to the direction of movement of the conveyor, and into a dual rotary wire brush cleaning device which cleans that end of the fusee to which the wire support stand will be secured. Upon completion of the cleaning operation, the gripper device returns the fusee to its original position for further movement toward the injection mechanism.

The fusee is thereafter discharged from the inclined conveyor, whereupon the injector mechanism pushes the fusee into the opening in the front face of the holding device on the turntable as previously described. It is important to note that, during this operation, the fusee contacts the base portion of the wire support stand and thereafter carries the wire support stand approximately three inches beyond a rearward face of the holding device. This rearward exposure of the end portions of the assembled support stand and fusee provides the necessary clearance for the subsequent tape application and wrapping operations.

The fusee and support stand are held by the holding device only under relatively light spring bias pressure of individual clamping elements mounted therein. However, as the turntable indexes to the tape applicator station, a switching device actuates a piston/cylinder assembly associated with the holding device to apply pneumatic pressure against the individual clamping elements so as to securely clamp the support stand/fusee assembly in place within the holding device.

At the tape applicator workstation, a conventional tape applicator device, such as that sold by the Tapeler Corporation and as disclosed, for example, in U.S. Pat. Nos. 3,649,413 and 3,625,799 is utilized to apply a strip of tape of approximately four inches in length, and approximately three inches in width, across the exposed rearward end of the fusee. The turntable is then indexed to a tape wrapping workstation where a rotatable, generally C-shaped fork, mounting flexible spring like inserts, wraps the tape about the fusee/support stand so as to securely fasten one to the other.

Once the tape is wrapped securely about the fusee/-support stand assembly, the pneumatically actuated clamping elements within the holding device are released so that the assembled fusee may be removed from the holding device and transferred to an off-load conveyor at a discharge station. This conveyor, in turn, delivers the finished fusee to a packaging station where the fusee is loaded into a box. After each box is filled, it is conveyed further downstream where it is sealed and loaded onto a shipping pallet or the like.

The indexable turntable preferably is provided with twelve workpiece holding devices about the periphery of its upper planar surface. As a result, and because of the location and number of workstations, as many as 7 fusees and 10 wire support stands will be positioned on the turntable at any given time during a continuous processing operation as fusees are intermittently loaded onto and discharged from the turntable. It will be further appreciated that the various operative components of the apparatus are actuated in timed relationship, with the intermittent indexing rotation of the turntable. Thus, except for the fusee cleaning device which may run continuously, all components are driven directly or indirectly by a central drive unit which may consist of, for example, a conventional electric motor and standard Ferguson drive intermitter. Through the use of conventional gearing, fluid actuators and mechanical switch operated solenoids well known to those skilled in the art, the wire forming and insertion operation, fusee supply and injection operations, and tape applying and wrapping operations are all performed in a timed, intermittent sequence which results in higher and more efficient production at lower costs than has been heretofore achievable in the prior art.

BRIEF DESCRIPTION OF THE DRAWINGS

FIG. 1 is a perspective view of an assembled fusee and support stand in accordance with this invention;

FIG. 2 is a perspective view of the fusee in FIG. 1 wherein legs of the support stand have been bent away from the fusee to an operative fusee supporting position;

FIG. 3 is a top view of a wire support stand of the type illustrated in FIG. 1;

FIG. 5 is a plan view of a workpiece holder and a wire support stand forming tool in accordance with an exemplary embodiment of the invention;

FIG. 6 is a front, elevational view of the workpiece holder illustrated in FIG. 5;

FIG. 7 is a cross-sectional view taken along the line 7—7 of FIG. 5;

FIG. 9 is a side cross-sectional view taken along the line 9—9 of FIG. 5;

FIG. 9A is a side elevation, partially cut away, illustrating a set screw and spring biased ball element used in the workpiece holder in accordance with the invention;

FIG. 14 is a front view of the supply hopper and infeed conveyor illustrated in FIG. 12;

FIG. 15 is a detailed side view of a flight of the infeed conveyor;

FIG. 16 is a side view of a toothed support wheel for use with the infeed conveyor in accordance with the invention;

FIG. 23 is a cross-sectional view taken along the line 23—23 of FIG. 22;

FIG. 24 is a cross-sectional view taken along the line 24—24 of FIG. 22;

FIG. 25 is a cross-sectional view taken along the line 25—25 of FIG. 22;

FIG. 27 is a top cross-sectional view taken along line 27—27 of FIG. 22;

FIG. 28 is an exploded side view of a pusher bar included in FIG. 22;

FIG. 29 is a top view illustrating extended fusee guide means between a fusee injection mechanism and an annular turntable;

FIG. 30 is a front view taken along the line 30—30 of FIG. 22;

FIG. 31 is a partially schematic diagram illustrating a conventional tape applying device for use with the subject invention;

FIG. 32 is a front view of the tape applicator device illustrated in FIG. 31;

FIGS. 33A-33C schematically illustrate a sequence of applying a strip of adhesive tape to a fusee in accordance with the subject invention;

FIG. 44 is an enlarged detail of the gripper arms of the fusee discharge gripper illustrated in FIG. 42B;

DETAILED DESCRIPTION OF THE INVENTION

Figure 11:
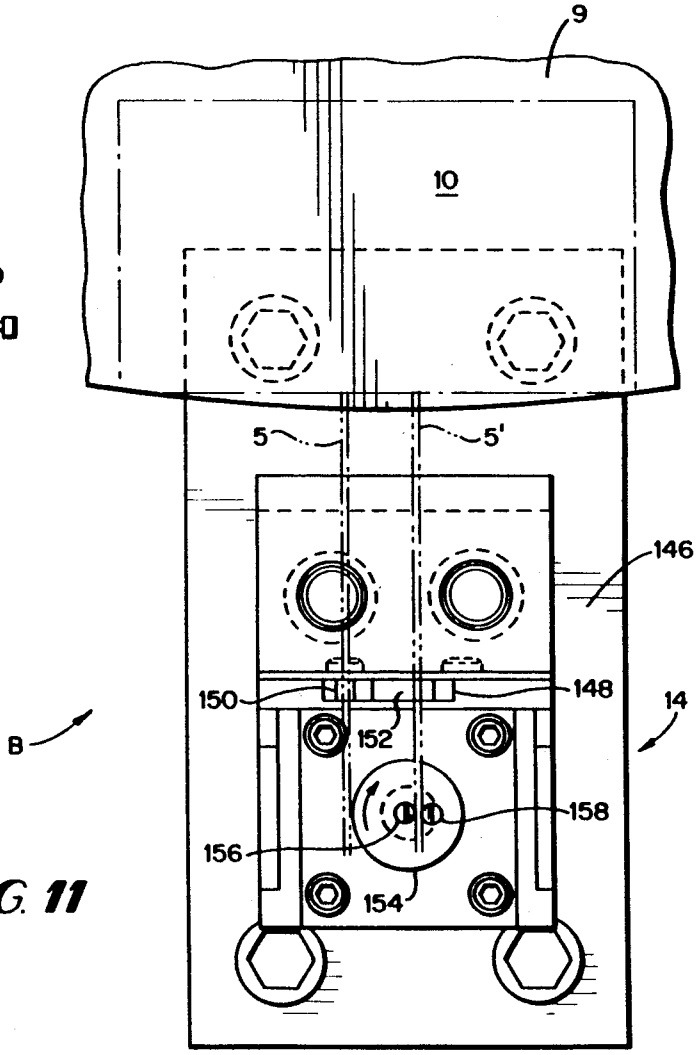
FIG. 11 is a top plan view of a curling tool for curling the free end of one leg of a support stand.

Referring to FIG. 1, there is illustrated a cylindrical road flare, or fusee, 1 comprising a body portion 2 provided with a cap, or ignition head 3 at a forward end and a U-shaped wire support stand 4 at a rearward end. The stand 4 includes legs 5, 5′ which extend along and generally parallel to the body of the fusee, and are interconnected at a lower end by a base portion 6. The outer, free ends of legs 5, 5′ are provided with inwardly directed curls 7, 7′. The wire stand is shown telescoped over the fusee with its lower end secured to the fusee by a wrapping 8 of polyfilament tape.

In use, legs 5, 5′ of the U-shaped wire stand 4 are bent downwardly and away from the fusee to a configuration generally as illustrated in FIG. 2. Of course, the legs may be bent as needed to have the fusee extend at the desired angle relative to the road or other surface. It will be appreciated that the support stand legs 5, 5′, along with the bottom of the fusee and base portion 6, provide a stable, three point support for the fusee.

Figure 4:
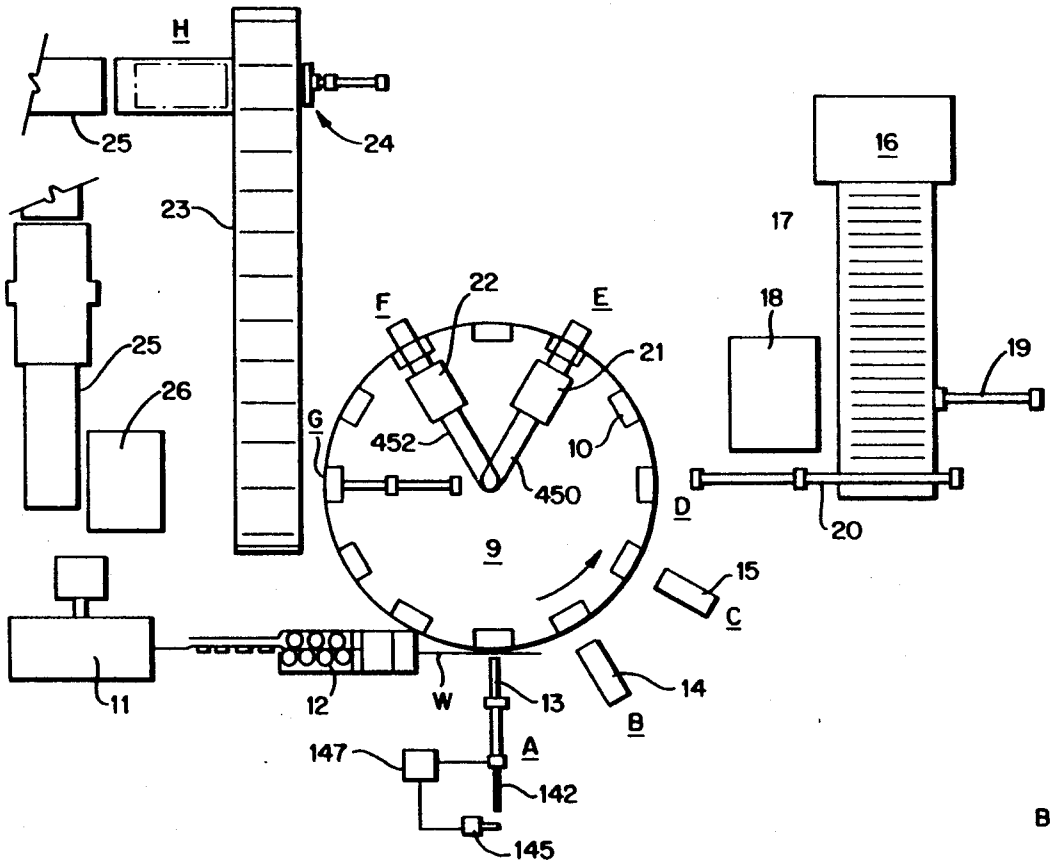
FIG. 4 is an overall schematic diagram of the apparatus in accordance with this invention.

Referring now to FIG. 4, there is disclosed an overall schematic plan view of apparatus for automatically assembling wire support stands to fusees in accordance with an exemplary embodiment of this invention.

The apparatus generally includes an annular carousel, or indexable turntable 9 which receives and indexes a number of fusees and support stands through a plurality of workstations A through G. The turntable itself is provided with twelve workpiece holders 10 located about the periphery of the upper planar surface table which, in broad terms, are designed to: (1) receive and hold the wire stands; (2) receive the fusees in assembled relationship with the wire stands; (3) clamp the assembled stands and fusees during subsequent tape applying and wrapping operations; and (4) release the finally assembled fusee products for discharge and packaging.

Generally, wire from a supply spool 11 is fed through a conventional wire straightening and cutting device 12 to a workstation A where successive lengths are cut and bent into U-shaped support stands 4 as they are pushed into the holders 10 by a hydraulically actuated plunger 13. At station B, legs 5 of the support stands 4 are acted on, successively, by a curling tool 14 which forms inwardly turned curls 7 at their free ends. At station C, an identical tool 15 is employed to form a similar curls 7′ at the free ends of the other legs 5′ of the support stands.

It will be appreciated that the wire support stands 4 are positioned in the workpiece holders 10 such that legs 5, 5′ extend outwardly, i.e., radially away from the turntable. In this way, at station D, fusee may be pushed, successively, into loosely assembled relationship with support stands 4 without interference.

Proximate to workstation D, fusees are removed from a supply hopper 16 by an upwardly inclined conveyor 17. In addition, as individual fusees move upwardly on the conveyor 17, they are diverted, sequentially, into a cleaning device 18 by a hydraulic plunger 19 and then retracted to resume their path of travel to an injection mechanism 20 which loads the fusees into successively presented holding devices 10 at station D. It will be appreciated that only those ends (the rearward ends) of the fusees which will receive the tape by which the support stands are secured to the fusee are cleaned. It will be further appreciated that when loaded into the holding devices, the rearward ends of the fusees, and the base portions of the support stands engaged thereby, project rearwardly from the holding devices, toward the center of the turntable, to facilitate application and wrapping of the tape without interference in a manner to be described in greater detail below.

As assembled stands and fusees approach the tape applying device 21 at station E, clamping inserts within the individual holders 10 are actuated to securely hold the stand and fusee against all movement. Predetermined lengths of tape are subsequently applied, but not wrapped, to the rearward ends of the fusees (preferably, about the rearmost three inches) by the tape applicator 21. At station F, a wrapping mechanism 22 wraps the lengths of tape tightly about the rearward ends of the fusees to securely and reliably fasten the support stands 4 to the fusees.

At station G, the assembled stand/fusee is removed successively from the holding devices 10 and are loaded onto a conveyor 23 which transports fusees in groups of, e.g., six, to a box loading station H where a pusher device 24 loads the groups of fusees into an open box. Thereafter, the loaded boxes are transported by a conveyor 25 and loaded onto one or more pallets 26 for shipping.

In order to have a full appreciation for the apparatus disclosed herein, it is necessary to first understand the structure and operation of the workpiece holders 10. Since all of these devices are identical, only one need be described in detail.

Figure 8:
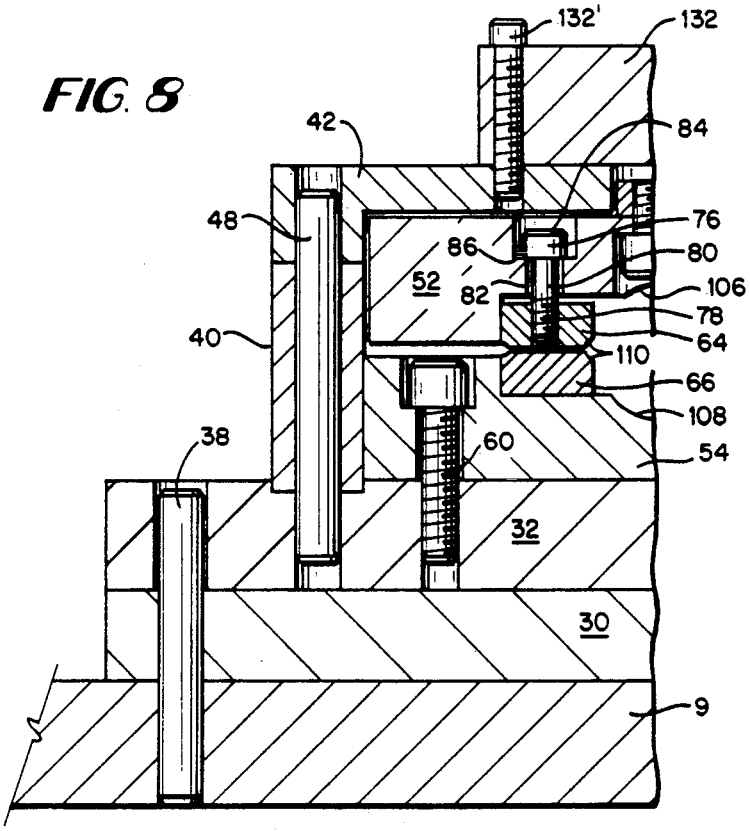
FIG. 8 is a partial cross-sectional view taken along the line 8—8 of FIG. 5.

Each workpiece holder 10 is arranged on the periphery of the turntable 9 in a substantially radial orientation so that the longitudinal axis of a cylindrical fusee held therein substantially intersects the axis of rotation of the turntable. As best seen in FIGS. 5 through 10, each holder has a flat, polygonal shaped lower base member 30 and a similarly shaped upper base member 32. The upper and lower base members are secured to the turntable by two pair of screws 34, 34' and 36, 36' as best seen in FIGS. 5–7. Accurate alignment and assembly of the base plates are facilitated by vertically arranged dowel pins 38, 38' as best seen in FIGS. 5 and 8. Mounted on the base assembly 30, 32 is an inverted U-shaped housing assembly comprising laterally spaced side walls 40, 40' and a top plate 42. Walls 40, 40' and top plate 42 are fixed to the base assembly by two pairs of screws 44, 44' and 46, 46' extending from the top plate into the side walls, and with the further aid of a pair of dowels 48, 48'. Additional pairs of screws extend from the base plate assembly into the side walls, two of which are shown at 50, 50' in FIG. 7.

Within the holder housing formed by base plates 30, 32 side walls 40, 40' and top plate 42 are upper and lower clamping blocks 52, 54, respectively, which are vertically and horizontally aligned with the aid of two pair of dowel pins 56, 56' and 58, 58' which extend from the top plate 42 through the clamping blocks 52, 54 and through the upper base plate 32 to seat against the lower base plate 30.

The lower clamping block 54 is secured against movement by a pair of screws 60, 60'. Upper block 52 is free to move within limits along the dowel pins 56, 56' and 58, 58' as further described hereinbelow.

The upper and lower clamping blocks partially define a central cavity 62 in which are mounted upper and lower pairs of inserts 64, 64' and 66, 66', respectively. The lower inserts 66, 66' are fastened to the lower clamping block 54 by two pair of screws, three of which are shown at 68, 68' and 70' in FIGS. 7 and 9. The upper inserts 64, 64' are mounted for slight sliding or floating movement relative to the upper block 52 by means of two pairs of dowel pins 72, 72' and 74, 74'. Pins 72 and 72' are located toward the forward or entry end of the holder, while pins 74 and 74' are located toward the rearward end of the holder. Centrally located in each of the upper inserts 64, 64' are screws 76, 76' which secure hold the upper inserts to the upper clamping block, but which allow some sliding movement along the dowel pins 72, 72' and 74, 74'. This can best be seen in FIG. 8 where screw 76 is provided with a threaded portion 78 and a smooth shank portion 80. The threaded portion is received in a threaded bore formed in the insert 64 while the smooth shank portion is slidably received in a smooth bore 82 formed in the upper clamping block. This construction allows the upper insert 64, to float or self-adjust, vertically with respect to the upper clamping block 52. As will be appreciated from FIG. 8, the enlarged head of the screw 76 is received within a recess 84 formed in the block 52, the lower surface 86 of the recess providing a stop to limit downward movement of the insert 64. Adjustment of the insert to define the range of vertical movement is thus seen to be easily accomplished by turning the screw 76 in a clockwise or counterclockwise direction.

Upper block 52 is further provided with a pair of bores aligned along and above each of the inserts 64, 64'. One pair of bores will be described with respect to insert 64' as view in FIG. 9, it being understood that this construction is repeated with respect to the laterally opposed insert 64 as well.

The bores 88, 89 threadably receive a pair of set screws 90, 92 from which spring biased ball elements project downwardly for engagement with the upper surface of insert 64'. One such set screw 90 is shown in detail in FIG. 9A. The screw 90 is provided at its lower end with a closed-end bore 92 which houses a coil spring 94, or other resilient means, for resiliently biasing outwardly a ball element 96. By adjusting the set screws in a conventional manner, the upper inserts 64' can be spring biased away from upper block 52 for relative movement with respect thereto. It will be appreciated that upper insert 64 may be similarly adjusted.

A similar pair of set screw and ball element assemblies 98, 100 are formed in the upper clamping block 52 but centrally located and along the axis of the cavity 62. A matching pair of set screw and ball element assemblies is also provided in the lower block 54 as shown at 102 and 104, diametrically opposed to the assemblies 98 and 100. The ball elements of each of these assemblies project outwardly from a curved surface area formed in each of the blocks 52, 44. Thus, as best seen in FIG. 7, upper block 52 is provided with a shallow groove or curved surface 106 running from front to back of the block. A similar groove or curved surface 108 is formed in block 54 directly opposite the groove 106. The ball elements of assemblies 98, 100 project from the groove 106, while ball elements of assemblies 102, 104 project from groove 108.

Curved surfaces 106, 108 comprise complimentary fusee engaging surfaces, with spring biased ball elements providing additional resilient holding action.

Figure 10:
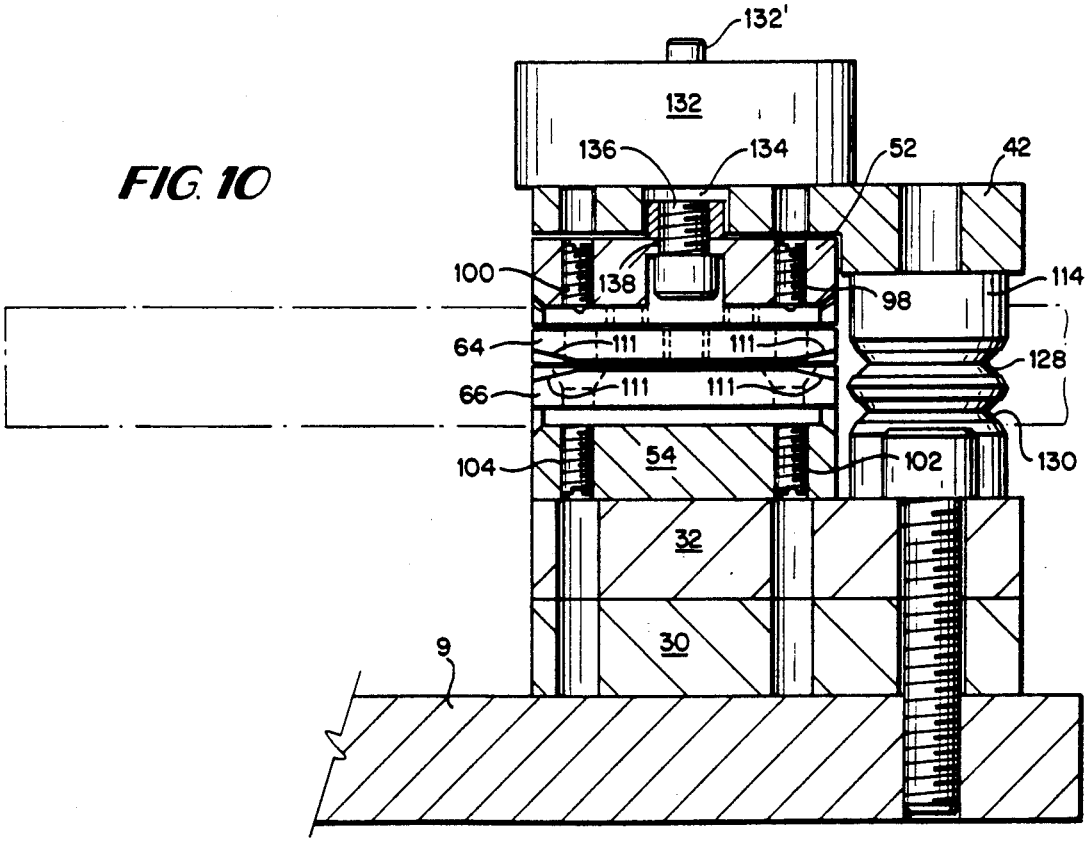
FIG. 10 is a side cross-sectional view taken along the line 10—10 of FIG. 6.

Referring specifically to FIGS. 7 and 8, it will be noted further that inserts 64, 65' and 66, 66' are each formed with a chamfered edge 110 along its respective length so that each upper and lower pair of inserts 64, 66 and 64', 66' combine to form generally semi-circular recesses for receiving the wire stand legs 5, 5' when the wire stand is simultaneously formed and pushed into the holder at workstation A. Forward and rearward surfaces of the inserts may be chamfered as well as shown in FIG. 10 at 111 to facilitate entry and withdrawal of the fusees within the holders.

It will thus be apparent that upon the reception of the wire stand, and later the fusee, inserts 64, 64' and 66, 66' will resiliently hold the wire stand 4 in place, while the fusee itself will be resiliently engaged by set screw and ball element assemblies 100, 102 and 104 within the curved surface areas 106, 108.

Mounted at the entry end of the holder, on either side of central cavity 62, are freely rotatable profiled rollers 112, 114. Because they are identical, only one of the rollers need be described in detail. As illustrated in FIGS. 6, 9 and 10, roller 114 is rotatably mounted by stub shafts 116, 118 in sleeve bearings 120, 122 which are received in bores 124, 126, respectively, formed in plate 42 and upper base block 32. The roller is formed with pairs of grooves 128 and 130. The upper groove is aligned with chamfered edges 110 on the inserts 64, 66. Thus, the freely rotatable rollers 112 and 114 cooperate with the plunger 13 to form each wire support stand as it is pushed into a holding device 10 at workstation A. The grooves 128 also cooperate with chamfered edges 110 to hold wire stand legs 5, 5' during end curling operations at stations B and C, and to hold the stand in proper orientation as a fusee is inserted into the holder at workstation D for subsequent tape application at workstation E and wrapping at workstation F.

In light of the floating arrangement of upper block 52 and upper inserts 64 and 64', the inserts and block self-adjust upon reception of the support stand and fusee. This feature is particularly advantageous since each fusee/stand assembly will not, of course, be identical in every respect. The above described configuration allows for slight differences while providing an effective holding and gripping function necessary to the successful operation of the apparatus.

A fluid actuator 132 is mounted atop the holding device 10 by any suitable means such as screws 132'. Actuator 132 may be any conventional short stroke device. For example, a Fabco short stroke, double acting pancake cylinder with a 1/5/8 inch bore and a ⅛ inch stroke is preferably employed in this apparatus.

As shown in FIG. 10, upper block 52 is threadably connected to the piston 134 of the actuator 132 by screw 136 which passes through a recessed bore 138 formed in the block 52. It will be appreciated that when actuator 132 is triggered, the piston 134 acts on upper block 52 and upper inserts 64 and 64', as well as against the oppositely biased pressure of set screw and ball element assemblies 90 and 92 to positively clamp the wire stand and fusee within the central cavity 62 of the holder 10. This clamping action is utilized during the tape applying and wrapping operations at stations E and F. The actuator 132 is triggered and released by switch devices mounted on the turntable as described further hereinbelow.

Referring again to FIG. 4, and as earlier indicated, at station A wire W from a coil 11 is fed through a straightening and cutting device 12. A predetermined length of wire is located across the front face or entry and of a workpiece holder 10, and within the grooves 12B in rollers 112, 114. As shown more clearly in FIG. 5, once the cut wire W is centrally located with respect to cavity 62 of the holding device, vertically reciprocable clamping means 143, 143' of any suitable structure, are moved into position to releasably hold the wire W at this location. A suitably mounted piston/cylinder assembly 140 is actuated to cause plunger 13 to push the wire W at its axial center and into the holder 10 between the plunger and the grooves 128 as rollers 112, 114 rotate due to frictional engagement with the wire. As the plunger 13 continues its forward motion, the wire is formed into a substantially U-shaped configuration, with legs 5, 5' received in recesses formed by chamfered edges 110 of inserts 64, 64', 66 and 66', as well as grooves 128. It will be understood that the clamping means 143, 143' may be adjusted to somewhat loosely hold the wire as the piston 142 is moved forward to bend the wire stand, so that the free ends 5, 5' are drawn out of the clamping means as the wire is pushed into the holder. The clamp 143' may also be provided with a stop element affixed, for example, to a lower jaw (not shown) for stopping the wire in the desired location as it is moved into position from the coil 11 and straightening and cutting device 12.

In its fully loaded position, illustrated in phantom in FIG. 5, the base portion of the support stand projects from the rearward face of the holder 10. Upon withdrawal of the bending tool or plunger 13, a rearward extension 142' of the piston trips a switch 145 which actuates a retraction mechanism 147 which pivots the assembly 140 upwardly away from the table to allow the U-shaped support stand to be indexed to the next station without interference. While the retraction mechanism is not shown in detail, those skilled in the art will appreciate that any suitable conventional means may be employed to accomplish the upward pivotal movement of assembly 140.

At workstation B, as best seen in FIG. 11, a wire curling device 14 is arranged to curl one of the outwardly extending legs 5' of the stand 4. The device includes a base 146 mounted on any suitably configured framework, and a vertically reciprocable wire support block 148 including grooves or slots 150 and 152 for receiving legs 5, 5' of the wire stand 4. In addition, a vertically reciprocable curling head 154 is rotatably mounted on the base and driven by any suitable conventional drive mechanism.

It will be appreciated that wire holding block 152 and curling head 154 will be in a lowered position as the table is indexed to bring a newly formed stand from workstation A to workstation B. Once in the properly aligned position, block 152 and head 154 are raised by any suitable, conventional reciprocatory drive, such as a fluid cylinder or the like, so that the legs 5, 5' of stand 4 are received in slots 150 and 152 formed in the wire holding block 152, and so that the leg 5 to be curled is located between chamfered curling pins 156 and 158 mounted vertically on the head 154. Actuation of the curling head drive means causes rotation of head 154 and pins 156, 158 to bend the free end of the leg 5' inwardly (toward the opposite leg) and thereby form a curl 7' of the type shown in FIGS. 1-3.

Upon completion of the curling operation, the holding block 152 and curling head 154 are lowered out of contact with the stand legs 5, 5' and the table is indexed to the second curling station C (shown generally in FIG. 4) where a second curling device 15 is utilized to curl the end of other leg 5 of the stand 4. It will be understood that the curling head 15 at station C will rotate in the opposite direction to that of the curling head at station B, but otherwise the devices are identical, so that the second device at station C need not be further described.

Referring again to FIG. 4, once the ends of legs 5, 5' have been curled, the turntable is indexed to workstation D where a fusee is introduced into an aligned holder 10 with a finished wire stand 4 already held therein, the legs 5, 5' of which extend away from the turntable and generally toward the fusee injection device 20.

Figure 13:
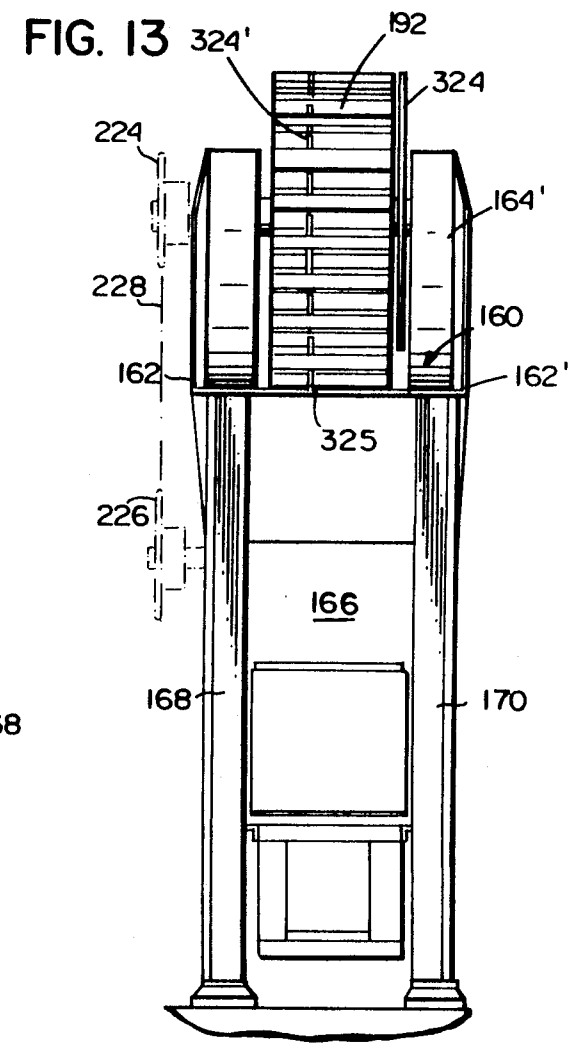
FIG. 13 is a rear view of the supply hopper and infeed conveyor illustrated in FIG. 12.
Figure 12:
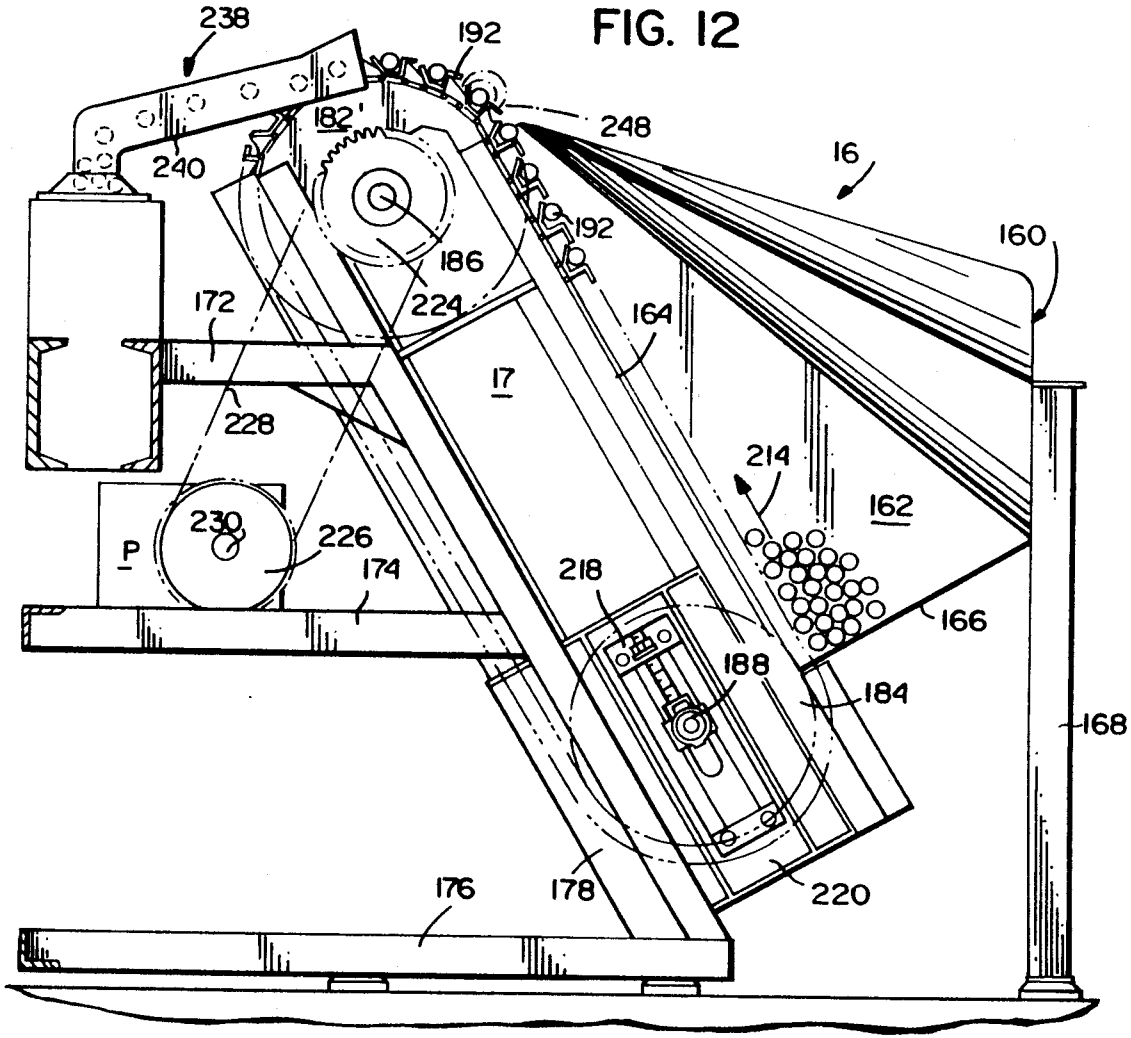
FIG. 12 is a side view of a fusee supply hopper and infeed conveyor in accordance with the subject invention.

With reference now to FIGS. 12, 13 and 14, a fusee supply hopper 16, located proximate the injection mechanism 20, is formed by an open bin 160 defined by side walls 162, 162' and a pair of intersecting walls 164, 166 which form a substantially V-shaped trough for supporting the supply of fusees. The wall 164 extends generally along the path of the upwardly inclined infeed conveyor 17 which transports the fusees from the hopper to the injection mechanism at workstation D. The hopper 16 and conveyor 17 are supported by vertical support beams 168, 170 connected to side walls 162, 162', respectively, as well as an assembly of pairs of horizontal beams 172, 172', 174, 174' and 176, 176' (see FIG. 14) which are joined by a pair of laterally spaced, angled beams 178, 180. It will be understood that the various beams may be secured together by any suitable means such as bolts, welding, etc. The supporting framework for the hopper and conveyor is connected at various points to the framework supporting the adjacent fusee injection mechanism 20 for added rigidity.

The inclined conveyor 17 includes an upper, laterally spaced pair of sprockets 182, 182', and an identical, lower pair of laterally spaced sprockets, only one of which is shown in phantom at 184 in FIG. 12. The upper pair of sprockets 182, 182' are mounted for rotation on a drive shaft 186, while the lower pair of sprockets are similarly mounted on an idler shaft 188. Endless link chains 190, 190' extend about the respective pairs of upper and lower, vertically aligned sprockets.

The fusee supporting portion of the conveyor is formed by a plurality of "flights" 192 which extend between, and are connected to, laterally aligned links of the chains 190, 190'. Each flight 192 has an elongated, trough-like shape for supporting a single fusee along an intermediate portion of its length, as best seen in FIGS. 12, 13 and 15. Additional lateral support for the fusees is provided by the underlying wall 164 of the hopper 16.

In FIG. 15, the cross-sectional shape of an individual flight 192 is shown in detail, and includes a first flat surface 194 which extends generally parallel to a chain link 196, and which serves as the mounting surface for attaching the flight to a pair of laterally aligned links. A second, inclined surface 198 extends away from surface 194 at an oblique angle, while a third surface 200 extends away from surface 194 in a direction substantially perpendicular thereto. In will be appreciated that a fusee carried by the flight 192 will be cradled between surfaces 198 and 200. A flange, or lip 202 extends at a substantially right angle from the third surface 200 and serves to bridge the distance between adjacent flights, at least in the straight line path of travel, so as to present a substantially continuous conveyor "belt" surface. It will be appreciated that as the flights enter the curved path areas of the sprockets, some separation will take place, as can best be seen in FIG. 12.

Generally, the flights 192 are attached to every other chain link to provide sufficient spacing for the flights. Referring again to FIG. 15, the flight supporting links are modified to include an upraised mounting surface 206 which extends between the link side plates (one of which is shown at 208) of the otherwise conventional link structure. The flat bottom wall 194 of the flight is seated on the surface 206 and is secured thereto by suitable fastening means, such as the screw 210 and nut 212.

It will be understood from FIGS. 12 through 15 that each flight 192 is configured to pick up a single fusee from the batch of fusees in the hopper 16 as the flight moves out of the curved path defined by the lower sprockets and into the upwardly inclined, straight line path denoted by arrow 214 in FIG. 12. The configuration of the individual flights 192 insures that only one fusee will be received in each flight. In this regard, it will be appreciated that the batch of fusees in the hopper 16 should be generally oriented with the longitudinal axes of the fusees extending parallel, or substantially parallel, to the lengthwise direction of the flights, i.e., generally transverse to the direction of travel of the conveyor.

Tension in the chains 190, 190' may be controlled by a conventional tension adjustment mechanism 218 which permits the lower sprockets, along with shaft 188 to be shifted within the support structure 220 in a direction perpendicular to the longitudinal axis of the shaft, as will be readily understood by those skilled in the art.

As earlier stated, upper sprockets 182, 182' are fixed to a drive shaft 186 for rotation therewith. Referring specifically to FIGS. 12 and 14, the shaft 186 is conventionally journaled at 220, 220' and has an extending portion 222 which rotatably supports a drive gear 224. The gear 224 is coupled to a similar gear 226 by a chain 228. The gear 226 is mounted for rotation on a shaft 230 which extends parallel to shaft 186 and which constitutes the output shaft of a conventional Paradex drive unit P. An input shaft 231 to the drive unit 10 is connected through a suitable U-joint coupling 232 to a drive shaft 234 indirectly coupled to the main drive intermittor.

Also mounted for rotation on shaft 186 are a pair of laterally spaced, toothed wheels 324, 324' which assist in the fusee cleaning operation as explained in greater detail below.

At the upper end of the infeed conveyor 17 there is a discharge chute 238 which receives the fusees from the conveyor along an inclined ramp surface 240 which stores and aligns the fusees for sequential loading into the injection mechanism 20.

Prior to discharge of the fusees into the chute 238, the fusees are temporarily diverted from the infeed conveyor 17 to a cleaning device 18 located off to one side but closely adjacent the conveyor. The cleaning apparatus serves to clean only the rearward end of the fusee which will receive the wrapping tape at station E.

Figure 17A:
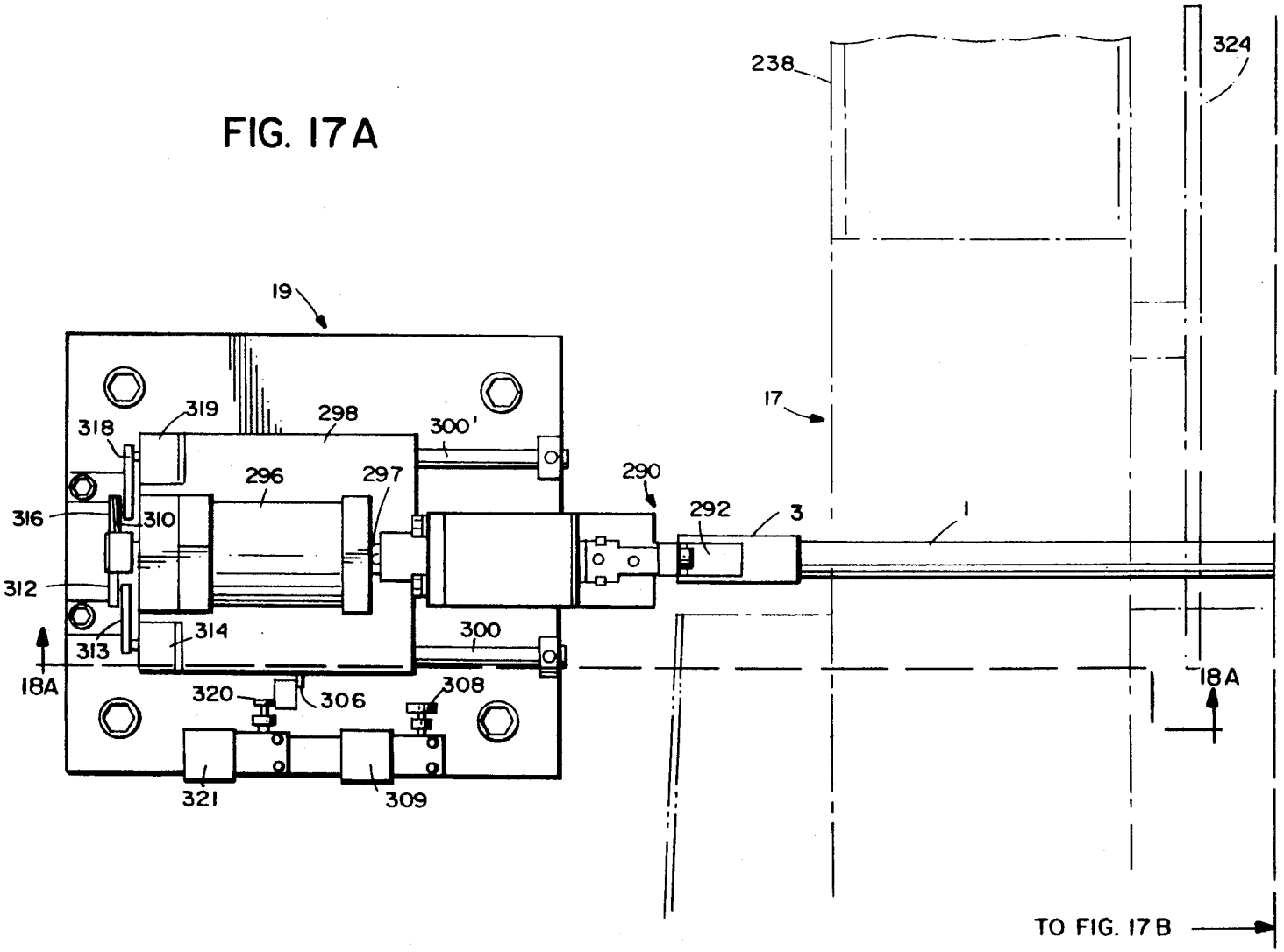
FIGS. 17A and 17B together comprise a top plan view of the fusee cleaning apparatus in accordance with the subject invention.
Figure 17B:
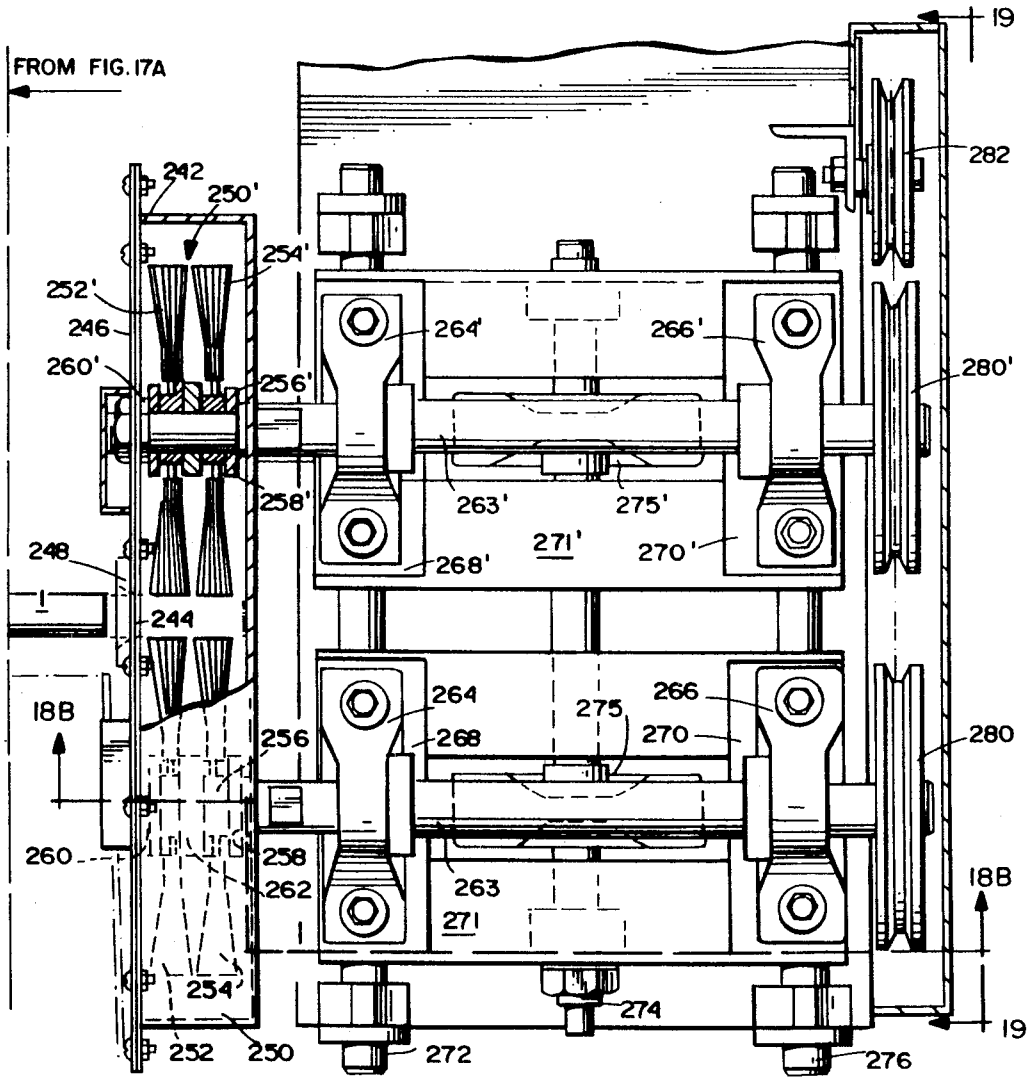

With reference now to FIGS. 17A, 17B, 18A, 18B, 19, 20 and 21, two rotatably mounted brush assemblies 250, 250' are arranged in side-by-side relationship and closely adjacent the upper portion of the conveyor. Assembly 250 comprises a pair of axially aligned wire brushes 252, 254, while brush assembly 250' includes a pair of axially aligned wire brushes 252', 254'. As best seen in FIG. 17A, assemblies 250, 250' are laterally spaced to permit insertion of the rearward end portion of a fusee therebetween for engagement with both pairs of wire brushes.

The brush assembly 250 is rotatably mounted on a reduced diameter shaft portion 256 of a shaft 263 and is held thereon between a shoulder 258 and a nut 260 threadably secured to the end of the reduced shaft portion. Similarly, brush assembly 250' is rotatably mounted on a reduced diameter shaft portion 256' of a shaft 263' and is held thereon between a shoulder 258' and a nut 260'. Spacers 262, 262' may be employed to maintain the adjacent wire brush components at a desired lateral spacing with respect to each other, and centered within a brush housing 242. The housing 242 is provided with an annular opening 244 in its front wall 246. A chamfered annular bushing or collar 248 is mounted within the opening and serves to guidingly receive the rearward end of a fusee for accurate positioning between the rotating wire brush assemblies.

Shafts 263, 263', which extend substantially parallel to one another, are rotatably journaled in bearing blocks 264, 264', 266 and 266'. The bearing blocks are, in turn, mounted on angle iron supports 268, 268', 270 and 270'. The angle iron members mount a pair of supporting platforms 271, 271' which are slidably movable along shafts 272, 274 and 276. Shaft 274, located between shafts 272 and 276, is rotatably journaled in bearing blocks 275, 275' which are secured to a base member 277 of the supporting framework. Thus, it is possible to adjust the wire brush assemblies laterally to achieve precise positioning with respect to the fusees and the gripper/feeder mechanism located on the opposite side of the conveyor.

Rearwardly extending ends of shafts 263, 263' have keyed thereto pulleys 280, 280', respectively. As most clearly illustrated in FIGS. 17B, 18B and 19, pulleys 280 and 280' operate in conjunction with an idler pulley 282 and a drive pulley 284 which is mounted to the drive shaft 285 of a motor 288. A belt or chain 286, operatively connects pulleys 280 and 280' with a drive motor 288 mounted on adjacent framework so as to drive the brush assemblies 250, 250' in opposite directions, as indicated by the arrows in FIG. 19.

While various of the other working components of the invention are driven intermittently in conjunction with the main turntable drive motor, there is no need for such intermittent drive with respect to the rotary brush assemblies 250, 250'. Therefore, in normal use, the rotary brush means may be driven continuously throughout the operation of the machine by the motor 288, although intermittent drive may be provided if desired.

Figure 18A:
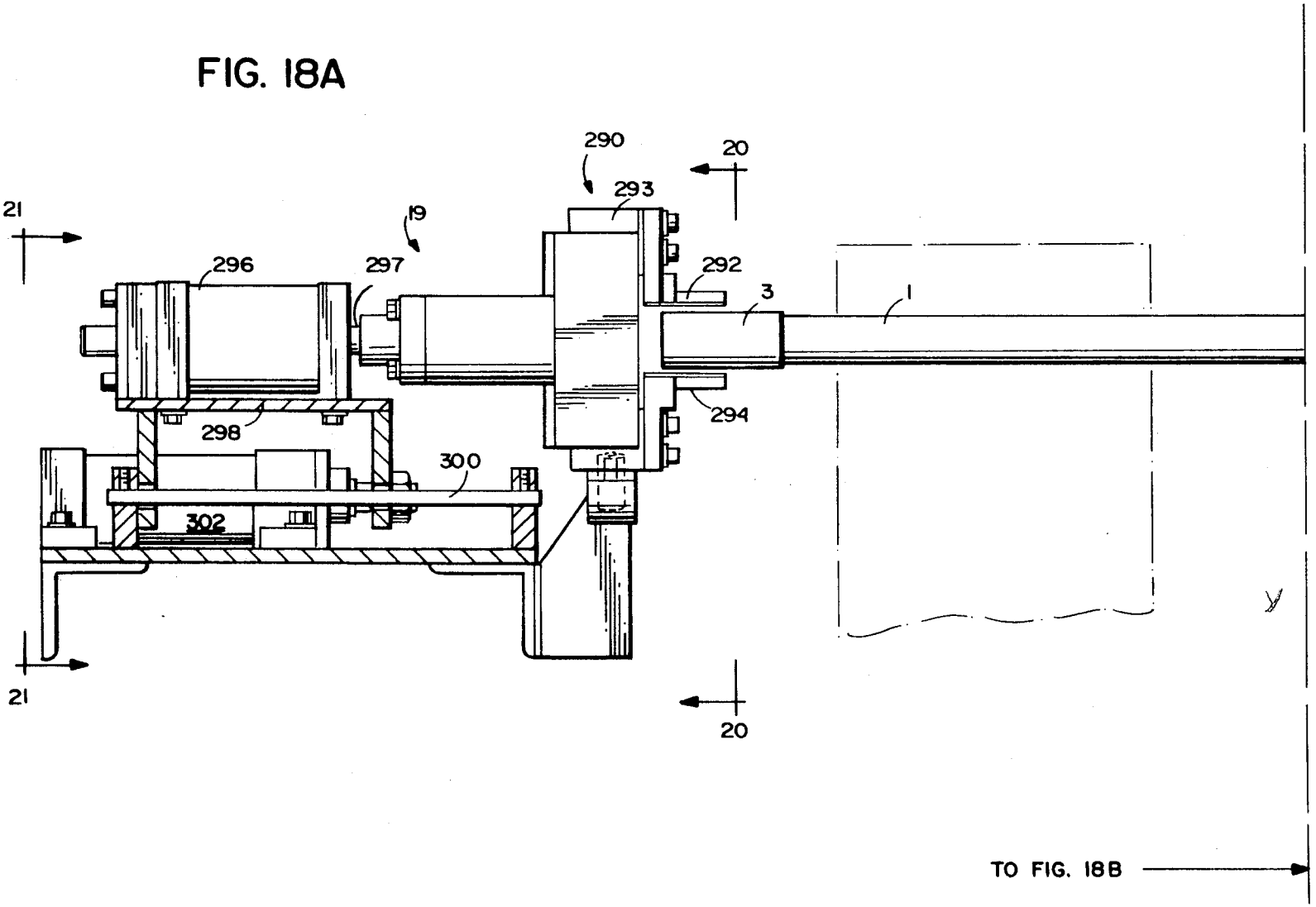
FIGS. 18A and 18B together comprise a side view taken along the line 18—18 of FIGS. 17A and 17B.
Figure 18B:
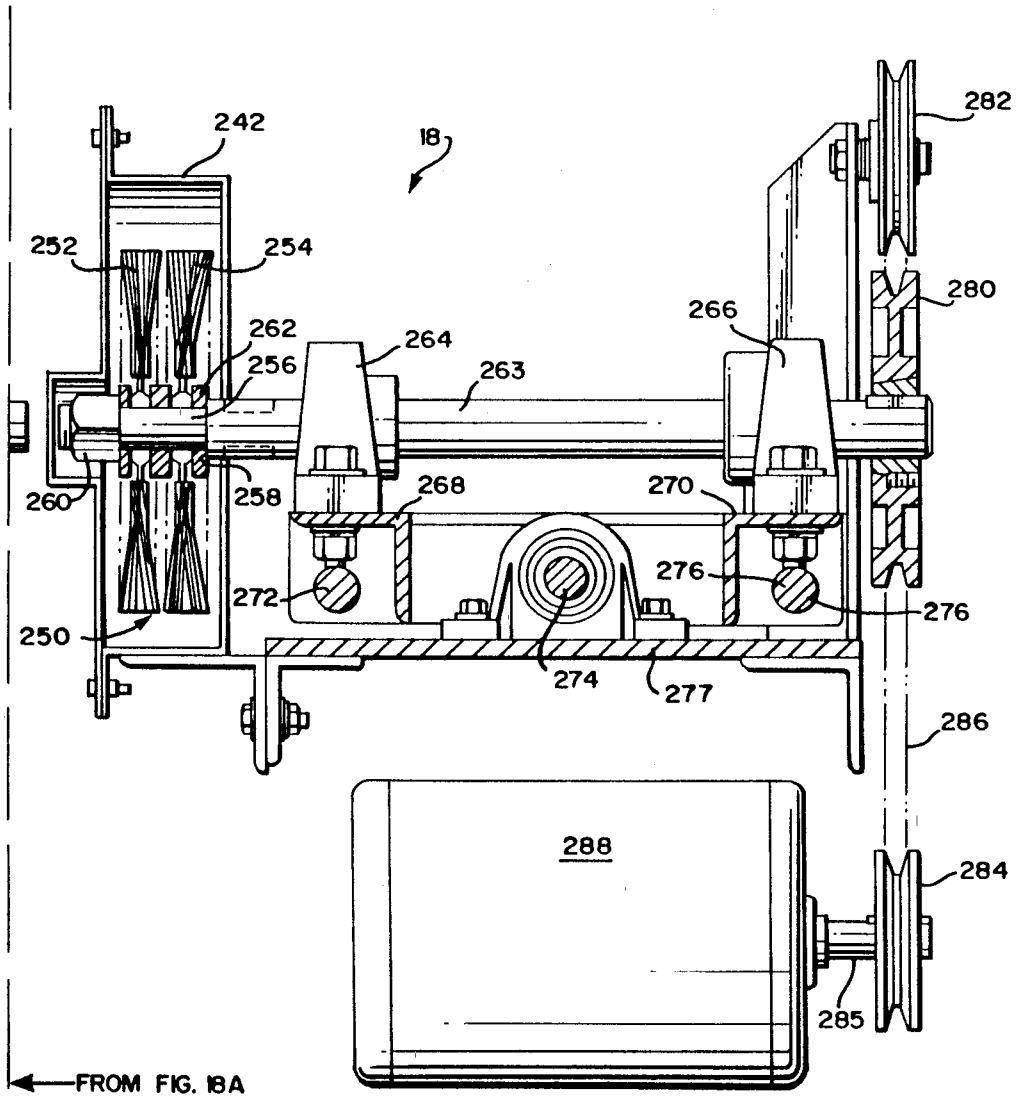
Figure 19:
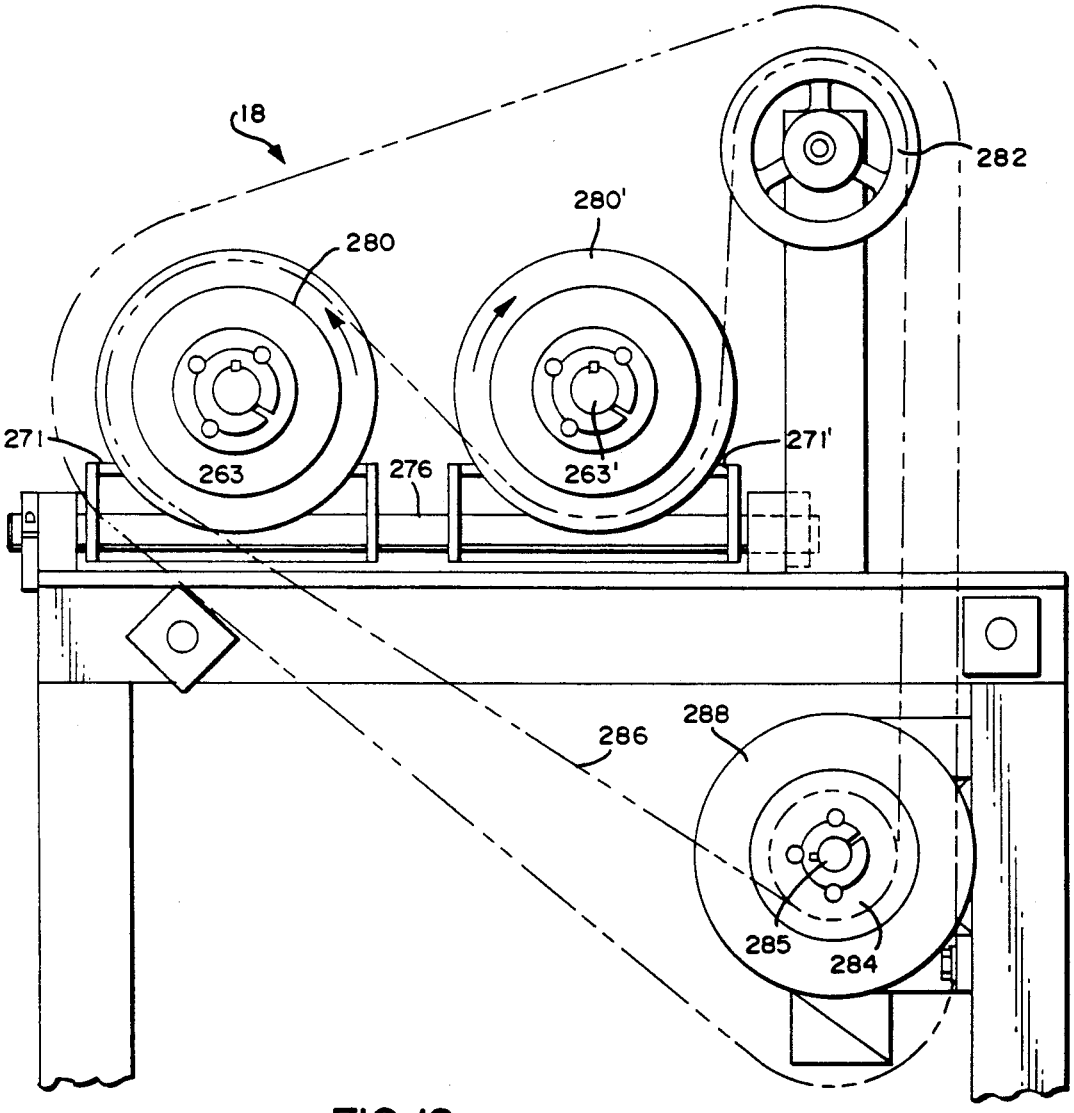
FIG. 19 is a rear view of the cleaning apparatus taken along the line 19—19 of FIG. 17B.

Aligned with the rotary brush cleaning device, on the opposite side of conveyor 17, is a fusee gripping and feeding device 19 for feeding individual fusees, sequentially, into the cleaning apparatus 18. With reference now to FIGS. 17A and 18A, as well as FIGS. 20 and 21, a parallel-jaw, fusee gripper/rotator assembly 290 is disposed to grip the ignition cap 3 at the forward end of a fusee 1 and to push the rearward end of the fusee through the annular collar 248 of the housing 242 so that approximately three to four inches of the rearward end may be cleaned by the wire brush assemblies 250, 250'. The fusee gripper/rotator assembly 290 comprises a pair of jaws 292, 294 slidably mounted within a guideway 293, and actuable from an inoperative position where they are spaced radially away from the fusee, to an operative position in which they firmly grip the forward or ignition end 3 of the fusee.

The gripper/rotator assembly 290 is mounted for rotation generally about the longitudinal axis of the fusee by a rotatable drive unit 296 via a rotary drive shaft 297. The rotary drive unit is mounted to a supporting frame 298 which, in turn, is mounted for sliding movement along a pair of aligned shafts 300, 300'. A linear actuator 302, which may be a pneumatically operated piston cylinder unit, is operatively attached to the supporting frame 298 and is actuable to drive the fusee gripper assembly 290 as well as the rotary drive unit 296 axially toward and away from the wire brush assemblies. It will be understood that the stroke of the linear actuator 302 is fairly short, and may be on the order of about four to five inches, taking into account the space between the end of the fusee as it rests on a conveyor flight 192, and the approximately three to four inch insertion into the cleaning apparatus.

A number of switching devices are provided to control the movement and operation of the fusee gripper/rotator assembly. Referring back to FIG. 14, a first switch 299 mounted on a frame member adjacent shaft 231 at coupling 232. The switch includes a pivotally mounted arm 301 which is intermittently engageable by a trip element 303 mounted on shaft 231 so as to intermittently actuate jaws 292, 294 to close upon the ignition end 3 of a fusee. A second switch 304, illustrated in FIG. 20, senses the closing movement of the jaws and actuates the linear actuator 302 to move the gripper assembly forward to push the rearward end of the fusee into the cleaning apparatus. As best seen in FIG. 17A, a projecting tab 306, mounted on the support platform 298, is arranged to engage a pivotally mounted roller 308 of a third switch 309 when the fusee gripper/rotator reaches the inward limit of its axial movement (toward the cleaning device). Switch 309, in turn, deactivates linear actuator 302 and causes the rotary actuator 296 to rotate the gripper/rotator assembly 180° to thereby insure complete cleaning action about the entire circumference of the rearward end portion of the fusee.

Figure 21:
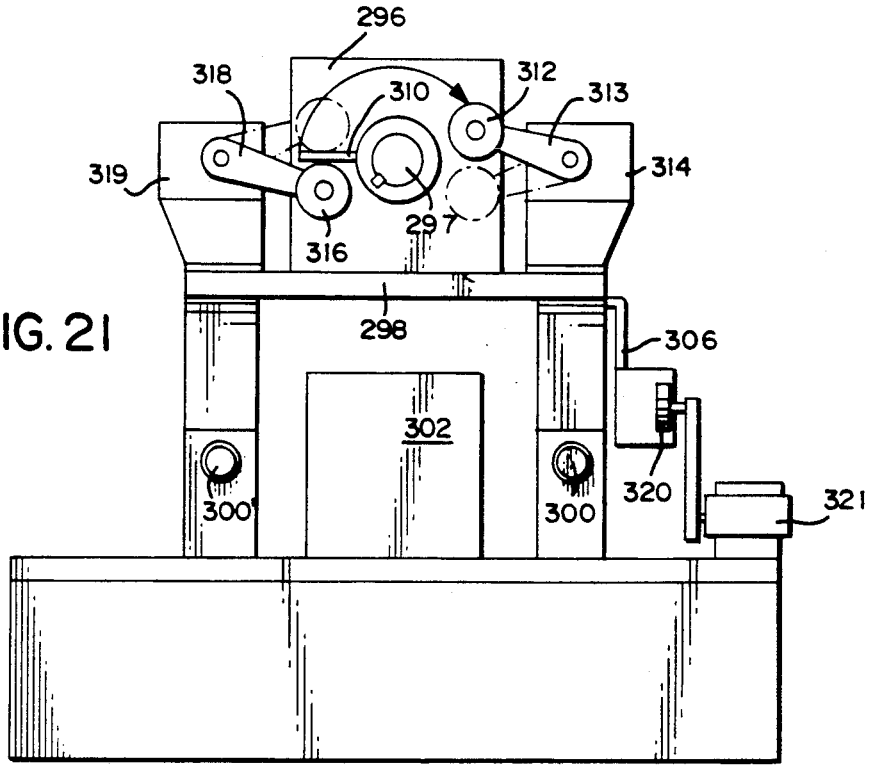
FIG. 21 is a rear view of the fusee gripper device taken along the line 21—21 of FIG. 18A.
Figure 20:
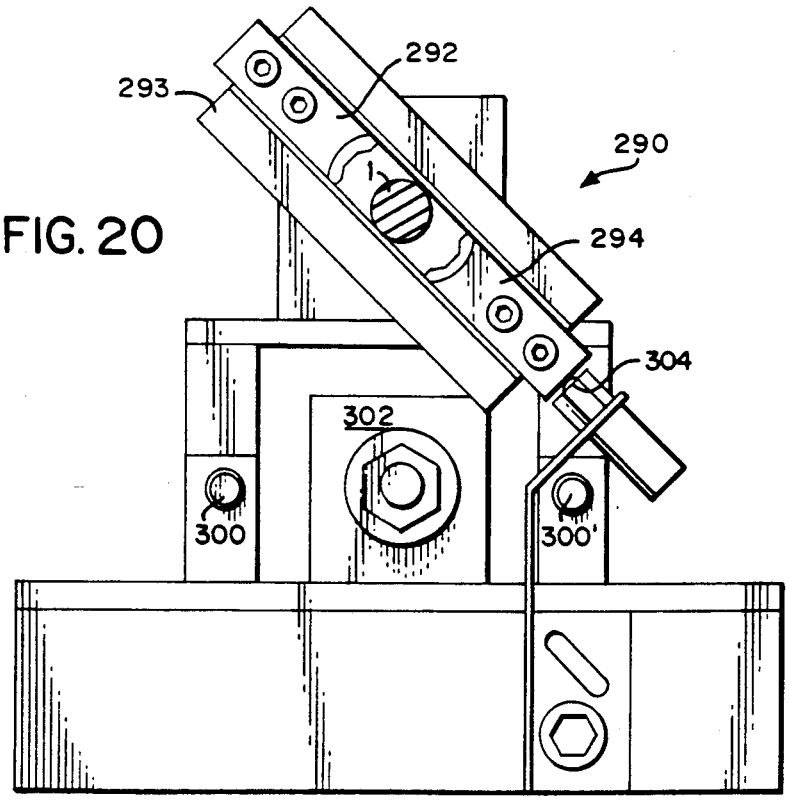
FIG. 20 is a front view of the fusee gripper device of the cleaning apparatus, taken along the line 20—20 of FIG. 18A.

Referring now to FIG. 21, a trip arm 310 is mounted on a rearward extension of the shaft 297 for rotation therewith. As shaft 297 rotates throughout its 180° range, it engages cam roller 312 mounted on a pivotable switch arm 313 of a fourth switch 314. Switch 314 deactivates the rotary actuator 296 and actuates linear actuator 302 to withdraw the fusee from the cleaning apparatus. As the gripper assembly, and platform 298, reach the rearward limit of its axial motion (away from the cleaning device), the projection 306 engages a pivotably mounted roller 320 of a fifth switch 321 which causes jaws 292, 294 to open for release of the fusee and in so doing, reset the switch 304 for the next fusee cleaning operation. In the subsequent fusee cleaning operation, rotation of the gripper assembly by rotary actuator 296 is 180° in the opposite direction, such that arm 310 will engage cam roller 316 mounted on a pivotable switch arm 318 of a switch 319. Switch 319, like switch 314, deactivates the rotary actuator 296 and actuates the linear actuator 302 to withdraw the fusee from the cleaning apparatus.

To facilitate movement of the fusee from the conveyor to the cleaning device, a pair of toothed wheels 324, 324' are mounted on shaft 186 (see FIGS. 12-16) for rotation therewith. As best seen in FIGS. 13 and 14, wheel 324 is located adjacent one end of the flights 192, while wheel 324' is mounted on shaft 186 between sprocket wheels 182 and 182'. This arrangement provides stable support for the fusee during the cleaning operation. In order to so locate the wheel 324', slots 325 are provided in the flights 192. Root surfaces 326 of the toothed wheels are configured to cooperate with the individual flights 192 as best seen in FIG. 15. The arrangement is such that as the fusees approach the cleaning station they are lifted off flights 192 and are supported by surfaces 326 during the insertion and withdrawal operations described hereinabove. The fusees thereafter remain supported by the wheels 324, 324' as the wheels continue to rotate and thereafter discharge the fusees into the chute 238 leading to the fusee injection mechanism 20.

Referring now to FIGS. 22 through 25, the fusee injection mechanism 20 is enclosed in an elongated housing 340 which is supported by suitable framework, which may include the supporting beams 172, 174, 176, etc. used to support the supply hopper/infeed conveyor described hereinabove.

The housing includes an elongated, rectangular, box-like framework including side walls 342, 344, a top wall 346, and a bottom wall 348. The latter is in reality a structural beam having depending flange portions 350, 352 to which the side walls 342, 344 are attached by screws, welds, or other suitable means. Reinforcing ribs 353 may be provided along the side walls for added rigidity.

The top wall 346 is formed with an elongated, centrally located slot 354 which extends throughout the length of the housing. The slot is further delineated by a pair of elongated angle members 356, 358 which are attached to the top wall and extend into and along the slot. Members 356, 358 present continuous, vertically oriented mounting surfaces 360,362 for a pair of elongated fusee support bars 364, 366. These support bars are provided with identical and complimentary profiled cross-sections which will be explained in greater detail hereinbelow.

Mounted for sliding movement within the housing 340 is an elongated, inverted T-shaped pusher bar 368 which includes a lower horizontal portion 370 mounted by screws or other suitable means to an upwardly extending vertical portion 372. The horizontal portion is provided with at least two pair of bushings, three of which are shown at 374, 376 and 378. These bushings enable the pusher bar to slide forwardly toward the turntable, and rearwardly away from the turntable, on a pair of elongated shafts 380, 382 supported on the beam 348 by a plurality of bearing blocks 384.

Figure 22:
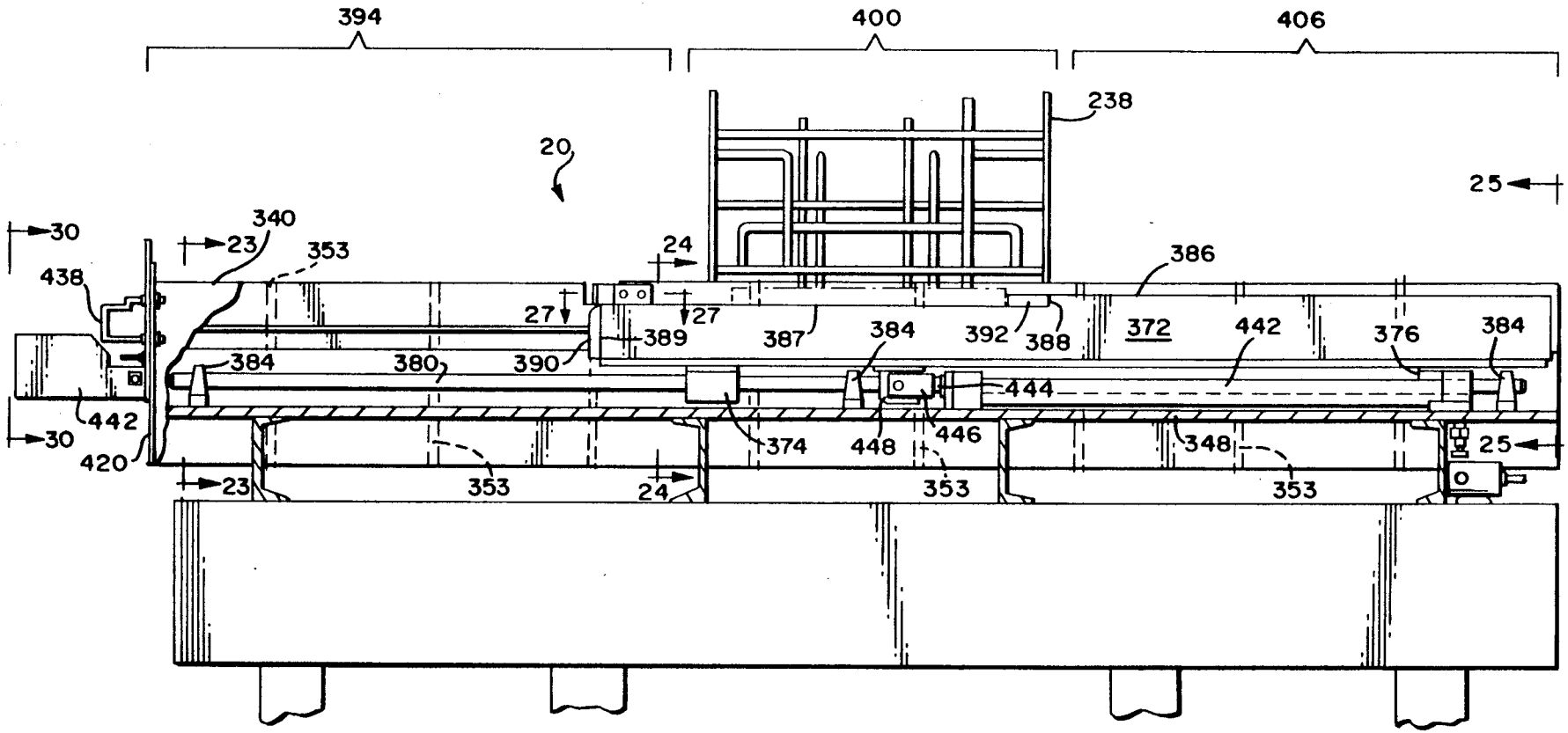
FIG. 22 is a side view of a fusee injection device for feeding a fusee to an annular work table in accordance with the invention.

The pusher bar vertical portion 372 is formed with a stepped surface configuration along its upper edge, as best seen in FIGS. 22, 26, and 28. A first upper surface 386 extends along the rearward half of the pusher bar, while a second, lower surface 387 extends along the forward half of the bar, the surfaces connected by a vertical shoulder 388. A forward vertical edge 389 of the pusher bar mounts a first, forward pusher member 390, while the shoulder 388 mounts a second, rearward pusher member 392.

Returning to FIGS. 23–25, it may be seen that support bars 364, 366 are each formed with three distinct cross-sectional profiles in three longitudinal sections of the bars. It will be understood that the profiles on one bar are mirror images of the profiles on the other bar. In addition, the support bars 364, 366 are laterally spaced apart a distance sufficient to permit the vertical portion 372 of the pusher bar to slide therebetween. Referring specifically to FIGS. 22 and 23, in a first forward section 394, which extends from the front of the housing 340 to a point just ahead of the discharge chute 238, the bars are provided with complimentary, inwardly curved, surfaces 396, 398 in the lower portion thereof which support a fusee (shown in phantom) in an insertion position, i.e., ready to be pushed into a holder 10 on the turntable 9.

Referring to FIGS. 22 and 24, in a second intermediate section 400 which extends from just forward of the chute to about the rearward edge of the chute, inwardly curved surfaces 402, 404 are provided in upper portions of the bars 364, 366 for supporting another fusee (also shown in phantom) in a loading position, above and behind the fusee in the insertion position.

Referring to FIGS. 22 and 25, a third profiled section 406 extends from about the rearward edge of the chute 238 to the rearward edge of the bars at approximately the rearward edge of the housing. This section is formed with inwardly projecting portions 408, 410, the upper edges of which are at approximately the height of the upper surface 386 of the pusher bar. Portions 408, 410 confine the fusees against any inadvertent rearward movement into the section 406. It will be understood that when the pusher bar 368 is in a retracted position, (as shown in FIG. 22) the second pusher member 392 is aligned generally at the rearward edge of second section 400 of the profiled bars, which also generally coincides with the rearward edge (the edge to the right in FIGS. 22 and 26) of the chute 238.

Figure 26A:
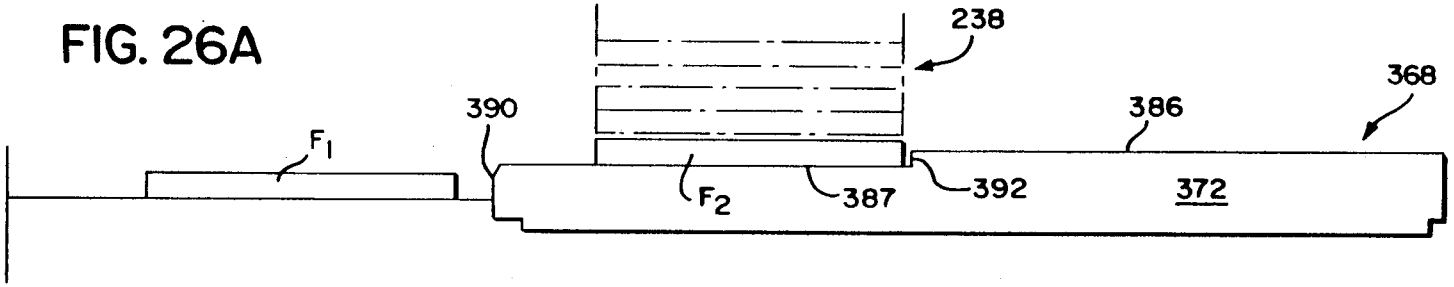
FIGS. 26A-26C illustrate schematically the sequential feeding of fusees from the fusee injection device to an annular turntable.
Figure 26B:
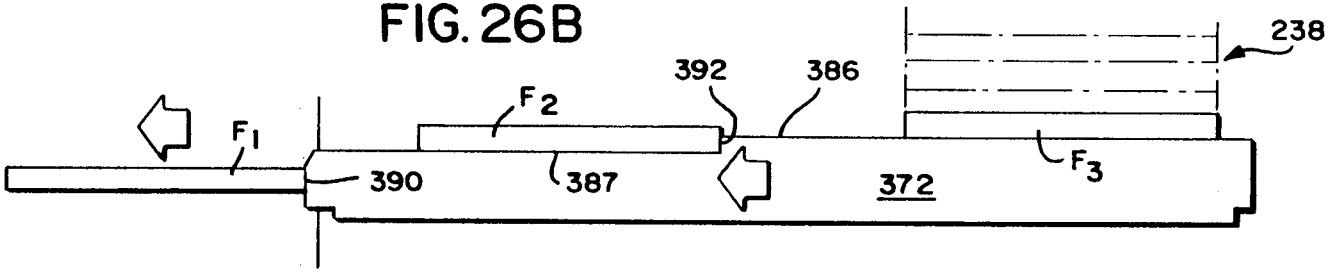
Figure 26C:
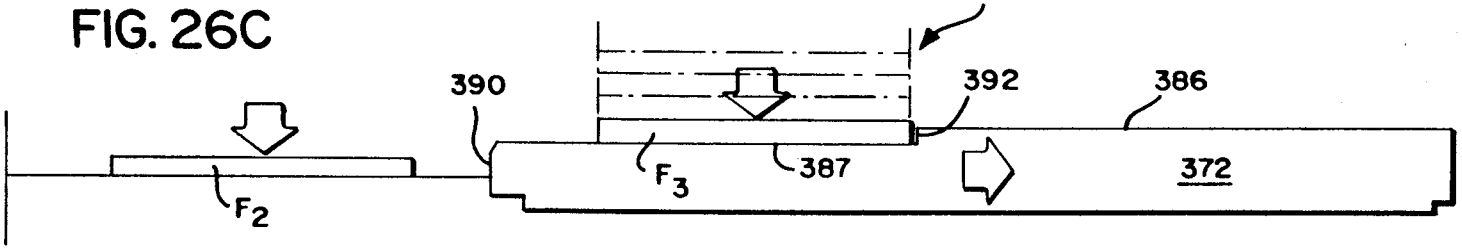

With specific reference to FIGS. 26A, B and C, the sequential fusee injecting operation will now be described. FIG. 26A shows the pusher bar 368 in its rearwardmost, or retracted position. In this position, a fusee $F_1$, is in the insertion position, corresponding to section 394 of the profiled bars 364, 366 on which it is supported. A second fusee $F_2$ has rolled into a loading position, supported by section 400 of the profiled bars and atop surface 387 of the pusher bar.

Upon actuation of the pusher bar to move it forwardly along shafts 380, 382, (to the left in FIGS. 26A through 26C), the forward pusher member 390 pushes fusee $F_1$ into a holder 10 on the turntable, and rearward pusher member 392 pushes fusee $F_2$ into the forward section 394 of the profiled bars, supported by surface 387 above curved surfaces 396, 398 of bars 364, 366. When the pusher bar is retracted, the fusee $F_2$ falls into the insertion position, supported directly by curved surfaces 396, 398 and forward of the forward pusher member 392.

At the same time, a third fusee $F_3$ rolls into the loading position, above and behind the fusee $F_2$. It will be appreciated that when the pusher bar 368 is retracted from the forward position illustrated in FIG. 26B, to its rearward position illustrated in FIG. 26C, there is a tendency for fusees $F_2$ and $F_3$ to move rearwardly with the pusher bar. As previously described, portions 408, 410 in section 406 of the profiled bars 364, 366 will prevent rearward movement of fusee $F_3$.

Rearward movement of fusee $F_2$ is prevented by a pair of laterally spaced, resilient leaf springs 410, 412 illustrated in FIG. 27. The springs are mounted by suitable means, such as screws 418, so as to protrude from cut outs 414, 416 formed in support bars 364, 366, respectively, into the path of the fusee, at the transition point between forward section 394 and intermediate section 400. As indicated by the arrows in FIG. 27, these springs are pushed outwardly by a fusee $F_1$ as it is pushed from a loading position to an injection position. As the rearward edge of the fusee passes the springs, they snap back into place behind the rearward edge of the fusee. In this way, the fusee, is prevented from moving rearwardly with the pusher bar 368. In other words, the springs 410, 412 act as stripping elements, removing the fusee from the pusher bar as it retracts, so that the fusee can fall downwardly into the injection position where it is supported by complimentary, curved surfaces 396, 398 of the profiled support bars 364, 366 in section 394.

This pattern of reciprocatory movement of the pusher bar to effect sequential loading and injecting of fusees, continues throughout the operation of the apparatus. It will be understood, of course, that the timing of the intermittent reciprocatory motion of the pusher bar coincides with the intermittent rotation of the turntable 9.

Another feature of the injection mechanism as best seen in FIGS. 22, 29 and 30, is the utilization of a guide plate 424 which projects beyond the front wall 420 of the housing 340, and which provides support for a fusee as it bridges the gap between the injection mechanism and a workpiece holder 10 on the turntable. A pair of rigid guide wires 426, 428 also project forwardly from the front wall 420 of the housing, and are arranged to provide lateral support for the fusee during the insertion operation. Wire 426 is stationarily mounted while wire 428, which lies in the downstream path of a fusee, is pivotably mounted to the forward wall 420 of the injection mechanism at 430. Pivotal movement of the wire is resisted by a coil spring 432 extending between wire 28 and a laterally displaced mounting screw 434. It will be understood that any other suitable resilient means may be employed to bias wire 428 into a fusee engaging position. An adjustable screw 436 provides a stop surface to accurately align the wire 428 in its normal upright position as shown in FIG. 30. After a fusee is loaded into a holder assembly 10, the fusee will push the wire 428 downwardly and away from its path of travel as it is indexed to the tape applying station E.

Because of the utilization of plate 426, and because the upstream wire support 424 is fixedly mounted to the forward wall 420, a camming wire 438 is mounted to the wall 420 at 440 to provide a ramp surface which cams the free ends 5, 5' of the wire support stands upwardly and out of the way of the plate 424 and fixed wire 426 as a workpiece holder assembly 10 is indexed into the injection station F. It will be appreciated that when an assembled fusee and wire support stand are indexed out of the injection station, the free ends 5,5 ' of the stand will pass completely over the camming wire 438 and, by reason of their inherent resiliency, will return to their normal position, closely adjacent the sides of the fusee.

With respect to the drive means for powering the pusher bar 368 through its reciprocatory movement, reference is made to FIGS. 22 and 25 where a linear hydraulic actuator 442 is shown mounted on beam 348, between shafts 380, 382. The piston 444 of the actuator is operatively connected, via coupling 446 to a mounting plate 448 fixed to the lower surface of the horizontal portion 370 of the pusher bar. It will be appreciated that any pneumatic or hydraulic linear drive means may be utilized, so long as it is adaptable to the intermittent movement of the main turntable drive. In this regard, control of the hydraulic actuator 442 may be effected by suitable mechanical switches similar to those employed with the previously described cleaning device. Such switches may be triggered, for example, by trip arms located on the turntable, so as to coordinate movement of the pusher bar 368 with the arrival of a workpiece holding device 10 at the insertion station D.

Figure 47:
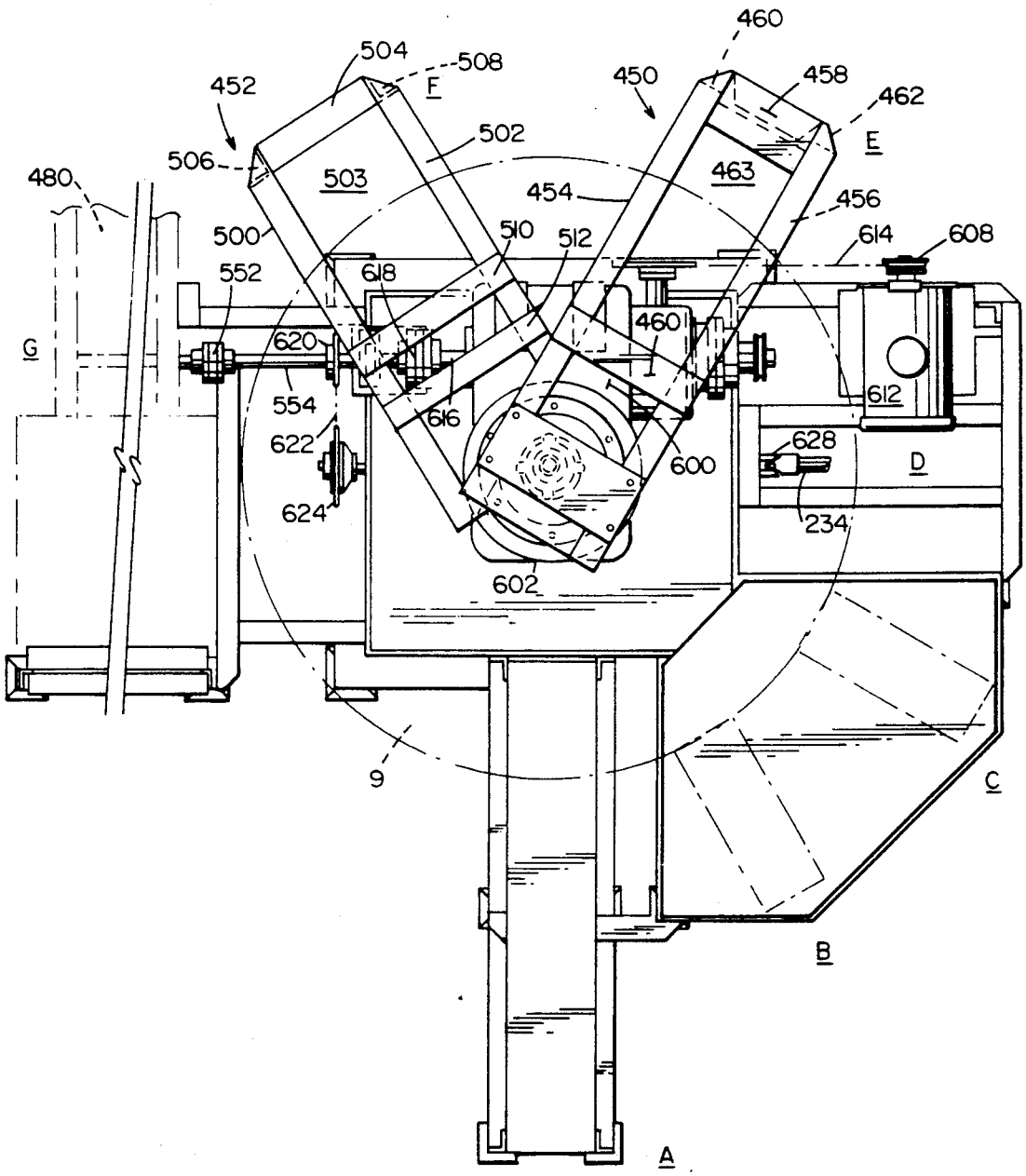
FIG. 47 is a partial top plan view of the annular turntable illustrated in FIG. 45.

With general reference to FIGS. 4 and 47, the tape applying device 21 and the tape wrapping device 22 are mounted for radially sliding adjustment with respect to the turntable 9 by elevated radial frameworks 450, 452, respectively, which extend from the center of the turntable outwardly in a V-shaped configuration. This arrangement permits both the tape applying device and the tape wrapping device to be accurately located with respect to the rearward end portions of the radially oriented fusees within the holder assemblies 10.

The first radial frame 450 for supporting the tape applying mechanism 21 consists of radially extending side beams 454, 456 connected at the radially outermost edge by a cross beam 458. Vertical beams 460, 462 extend to the floor, with suitable bracing, so that the supporting frame 450 remains fixed while the turntable rotates beneath the radially extending side beams 454, 456. An intermediate cross-beam 460 connects the side beams 454, 456 and defines a working window 463 which surrounds the tape applying mechanism 21.

Referring now to FIGS. 31, 32, as well as FIG. 47, cross-beams 458, 460 support vertically arranged members 464 and 466 between which extend a pair of guide tracks or shafts 468, 470. The tape applying mechanism 21 is slidably adjusted along the guide tracks 468, 470 between the supports 464, 466 for accurate alignment with the rearward end of the fusee which projects from the rearward face of holder 10 and lies directly beneath the tape applying device.

FIGS. 31 and 32 illustrate the tape applying mechanism in generally schematic form only, it being understood that the tape applying mechanism is a commercially available product sold by the Tapeler Corporation. The tape applying mechanism is similar, but not necessarily identical to those disclosed in the Tapeler U.S. Pat. Nos 3,649, 413 and 3,625,799, the disclosures of which are incorporated herein by reference.

Briefly, the tape applicator 21 feeds tape from a supply roll 472, around guide rolls 474, 476, 477 and onto a square, rotatably mounted applicator wheel, 478 which cuts a length of tape substantially the length of one side of the wheel, and holds the tape T with its adhesive side down by means of a vacuum applied through apertures on the side edges of the wheel or other suitable holding means. The wheel 478 is reciprocated upwardly and downwardly by a hydraulic cylinder 480.

With reference to the schematic diagrams in FIGS. 33A through 33C, it will be further understood that the Tapeler applicator has been adapted for intermittent actuation within the overall operational scheme of this apparatus through the utilization of conventional pneumatic and electrical controls. Thus, as a fusee F is indexed into position at workstation E (FIG. 33A), the cylinder 480 is actuated to move the applicator wheel 478 downwardly into engagement with the rearward end of the fusee (FIG. 33B). A predetermined length of tape, i.e., about four inches, which corresponds to the length of one of the four straight edges 482 of the wheel 478, is applied adhesive side down onto the rearward end of the fusee. Once applied, cylinder 480 retracts and the turntable is indexed to move the fusee to the tape wrapping station F (FIG. 33C).

At station F, a tape wrapping mechanism 22 is mounted on the radially oriented support frame 452. With reference again to FIGS. 4 and 42, the tape wrapping mechanism is mounted on a pair of radially oriented side beams 500, 502 connected at a radially outermost edge by a cross-beam 504 in generally the same manner as radial frame 450. Vertical beams 506, 508 extend to the floor surface in the same manner as beam 460, 462.

Figure 34:
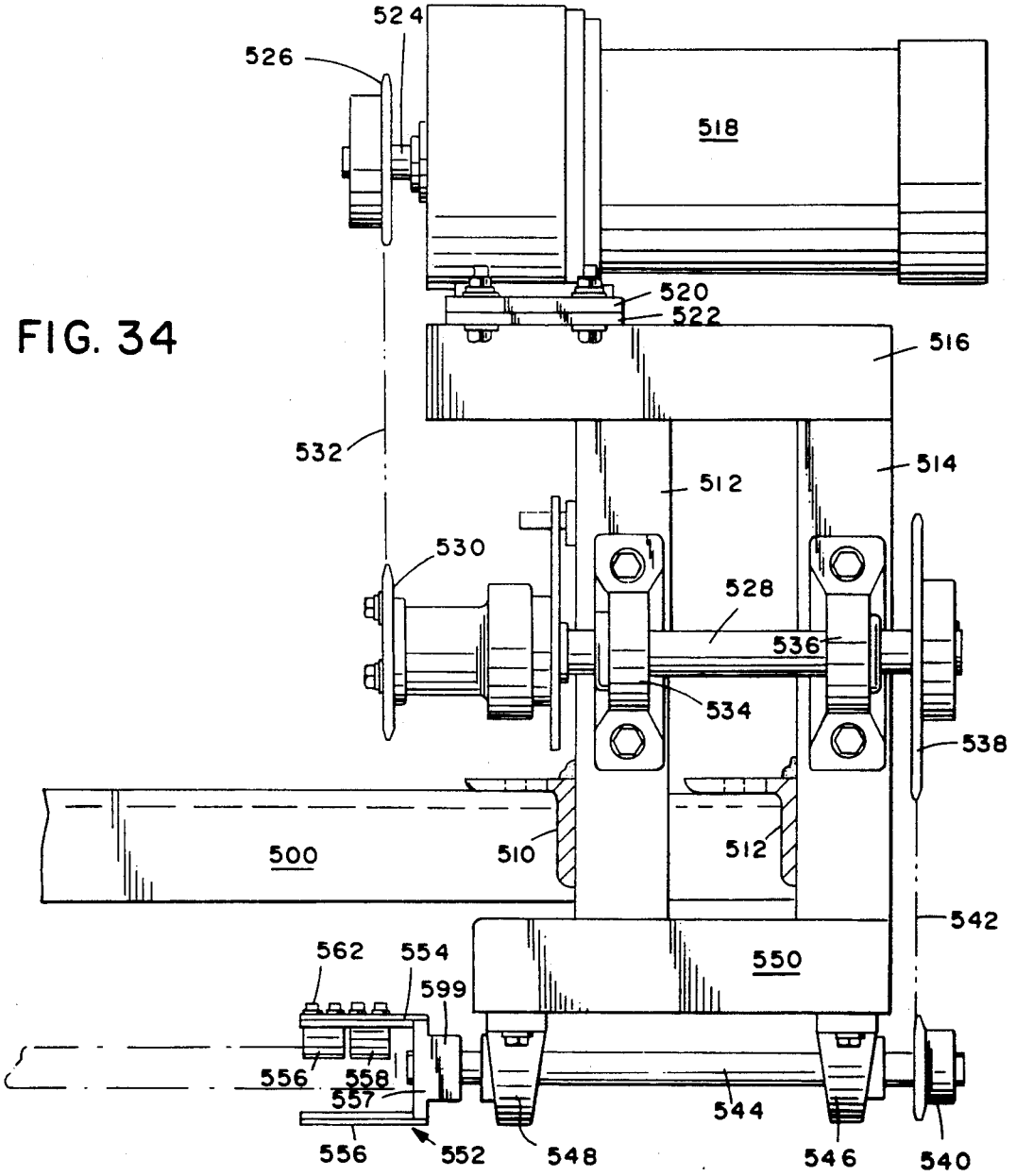
FIG. 34 is a side view illustrating a tape wrapping device in accordance with the subject invention.
Figure 35:
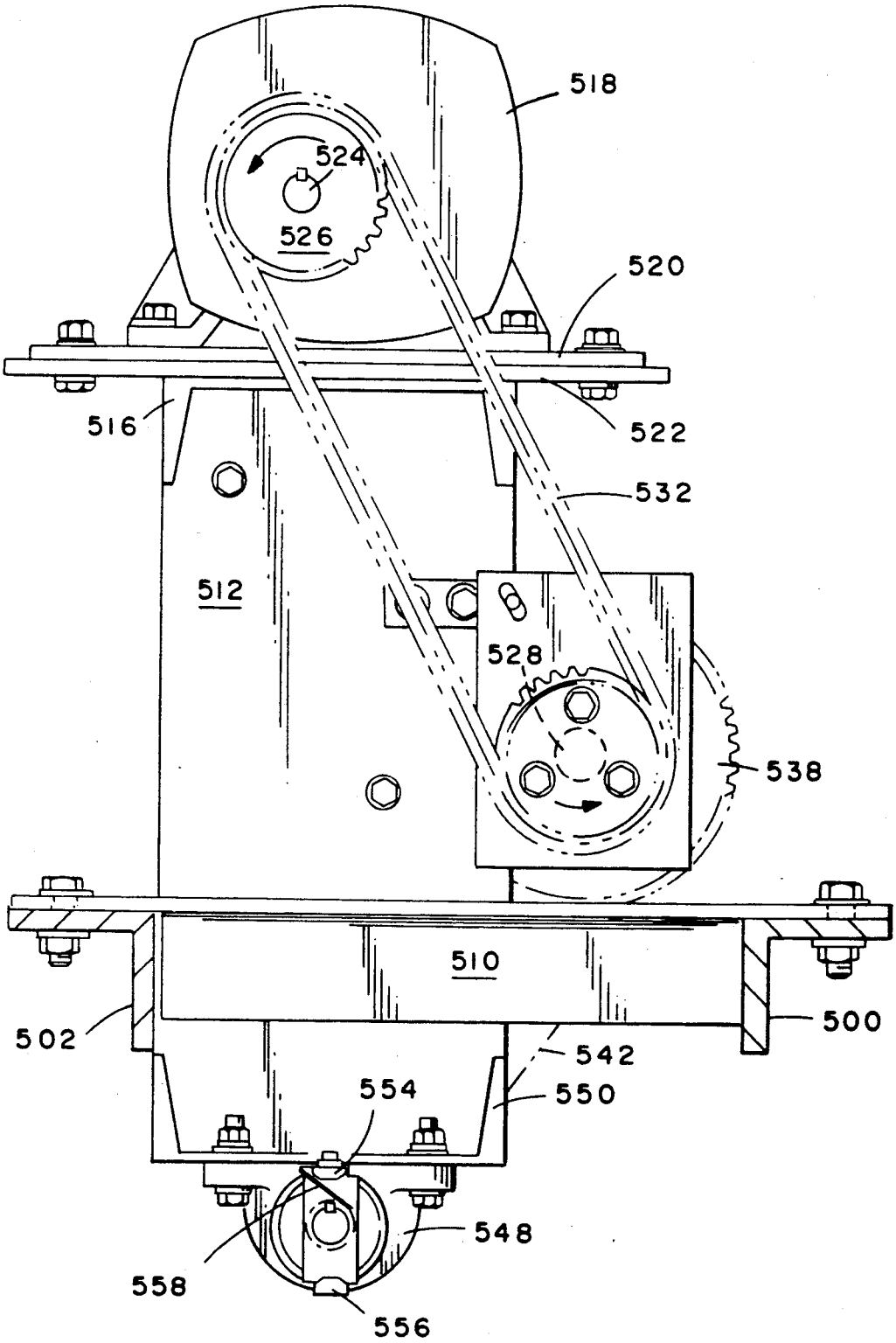
FIG. 35 is a front view of the tape wrapping device illustrated in FIG. 34.

Referring now to FIGS. 34 and 35, cross-beams 510, 512 extend between side beams, 500, 502 and define a working window 503 generally similar to window 463. A pair of additional cross-beams 510, 512 mount a pair of vertical motor supports 512, 514 which, in turn, mount a horizontal motor support 516. An electric motor 518 is mounted on the platform 516 via mounting plates 520, 522. A motor output shaft 524 mounts a sprocket 526 operatively connected to an intermediate drive shaft 528 by means of a similar sprocket 530. A chain 532 extends between the sprocket wheels 526 and 530 so that shaft 528 rotates with the motor output shaft 524. The intermediate shaft 528 is rotatably journaled in bearing blocks 534, 536 which are secured to the vertical support members 512, 514, respectively. The rearward end of the shaft 528 mounts a third sprocket 538 which is operatively connected, via chain 542, to a final drive sprocket 540 affixed to the tape wrapper shaft 544. The latter extends through bearing blocks 546 and 548 mounted on the lower surface of a support block 550 which is located beneath the radial support beams 500, 502.

Figure 36:
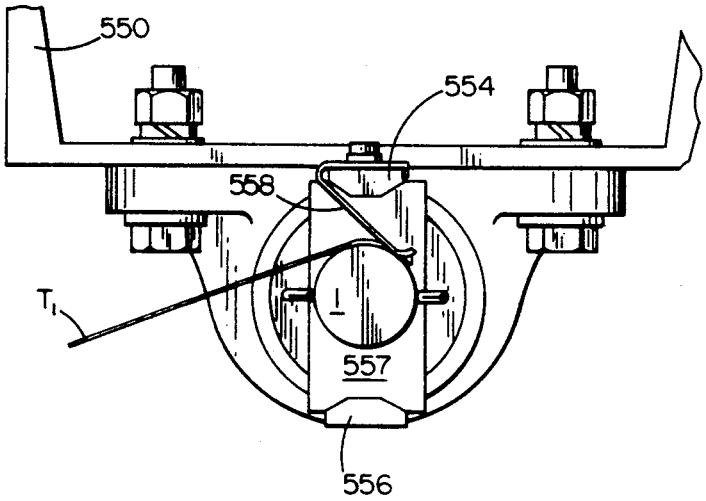
FIG. 36 is a detailed front view of a wrapping fork included in FIG. 35, and further showing a strip of adhesive tape in position to be wrapped.
Figure 38:
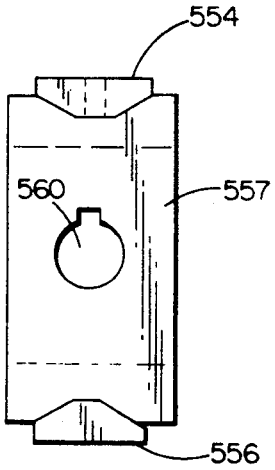
FIG. 38 is a front view of the wrapping fork illustrated in FIG. 37.
Figure 37:
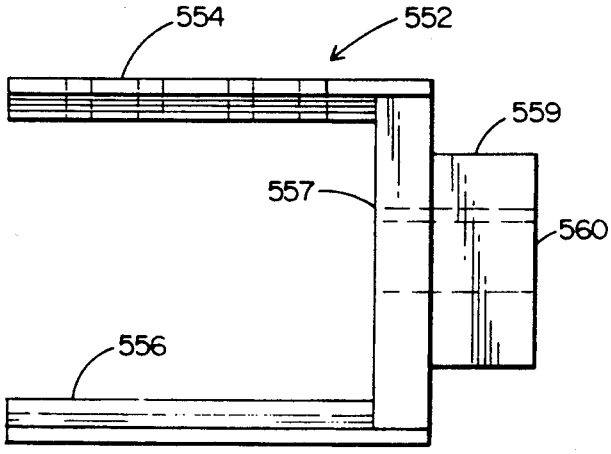
FIG. 37 is a side view of the wrapping fork illustrated in FIG. 36.

The tape wrapper shaft 544 mounts at its outermost free end a U-shaped wrapping fork 532 which extends into the window 503 beneath beams 500, 502. The fork is formed with radially outwardly extending parallel leg portions 554 and 556 which are arranged to receive a fusee therebetween. A base portion 557 includes a bushing 559 provided with a keyed opening at 560 by which the fork is connected to shaft 544 in a well known manner. Leg portion 554 is provided with a pair of resilient leaf springs 556, 558 which are designed to resiliently engage the fusee and the applied tape, initially, in the manner shown in FIG. 36. Shaft 534 is rotated via the above-described drive train by motor 518 in a counterclockwise direction as viewed in FIG. 36. It will be appreciated that the resilient leaf spring wraps the tape about the fusee and the wire support stand as the U-shaped wrapping fork 552 is rotated to tightly secure the support stand to the body of the fusee. After two or three complete turns of the wrapping fork, the motor is stopped in a position such that legs 554, 556 are vertically aligned, i.e., so that the fusee and holder assembly 10 may be indexed to the discharge station without interference.

Figure 40:
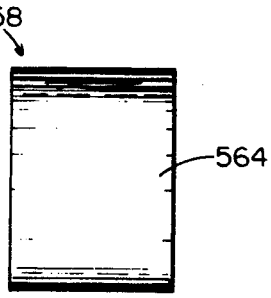
FIG. 40 is a front view of the spring-insert illustrated in FIG. 39.
Figure 39:
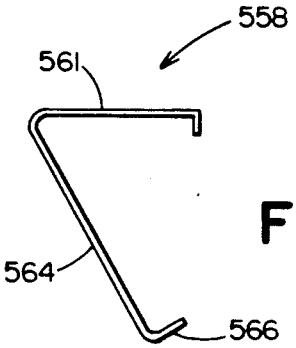
FIG. 39 is a side cross-sectional view of a spring-insert used with the wrapping fork illustrated in FIG. 37.

The resilient leaf springs 556, 558 are constructed in the manner shown in FIGS. 39 and 40. Each has a mounting face 561, by which the spring may be fastened, as by screws 526, or other suitable means, to the leg 554 of the U-shaped wrapping fork. A downwardly angled fusee engaging portion 546 terminates at an upwardly turned lip 566. The leaf springs are formed of a flexible resilient material, such as spring steel, which allows the fusee engaging portion 564 to flex as it rotates about the fusee and, particularly, as it passes over the leg portions 5, 5' of the support stand 4. At the same time, the springs are sufficiently stiff to insure that the tape is tightly wrapped about the fusee and support stand.

It will be appreciated that a single, longer spring insert, or as many as three relatively short spring inserts, may be employed, as desired.

After the wrapping operation is completed, the fusee and support stand are indexed to the final discharge station G.

Figure 42A:
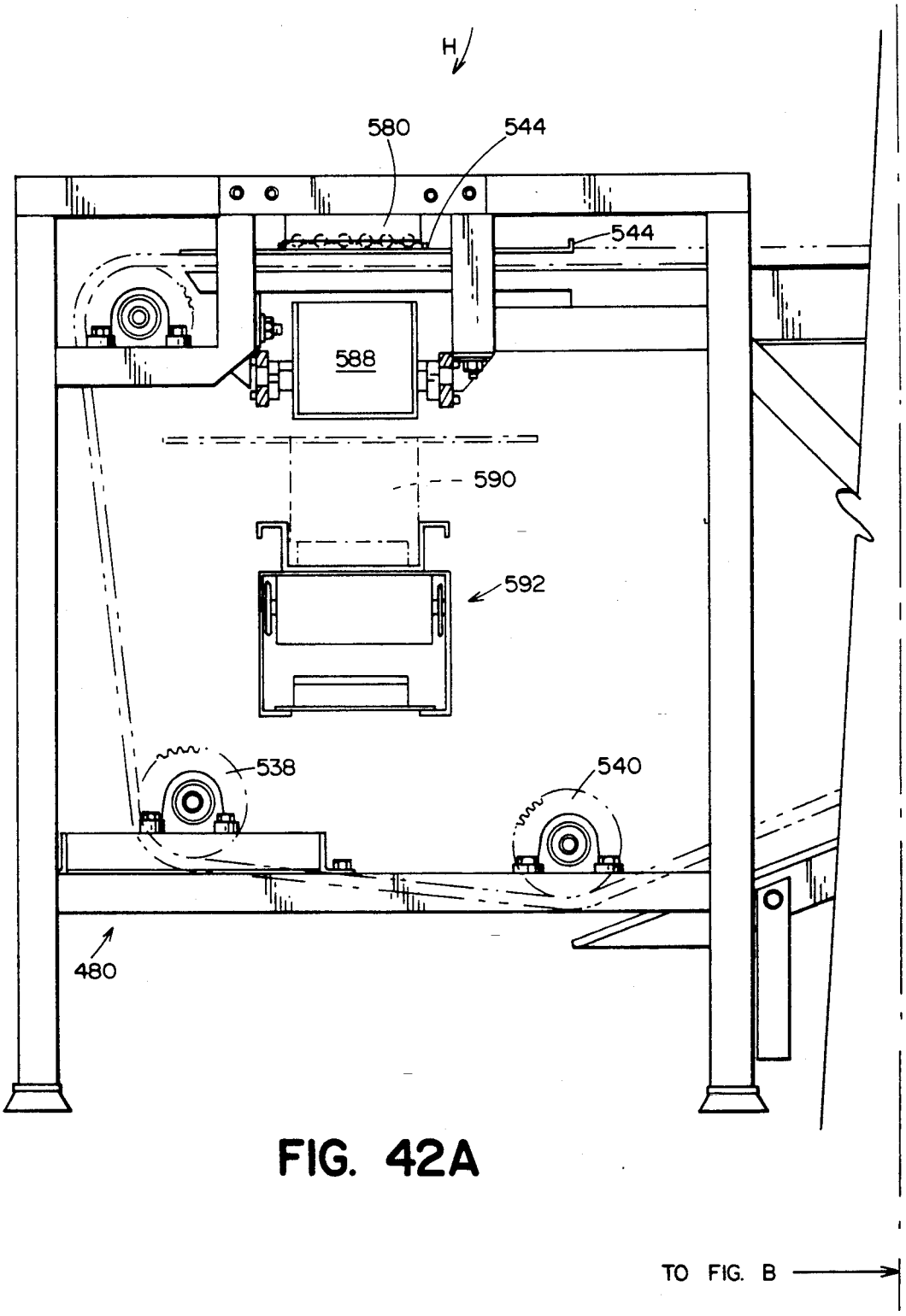
FIGS. 42A and 42B together constitute a side view of the fusee discharge device and off-loading conveyor illustrated in FIGS. 41*a* and 41*b;*
Figure 42B:
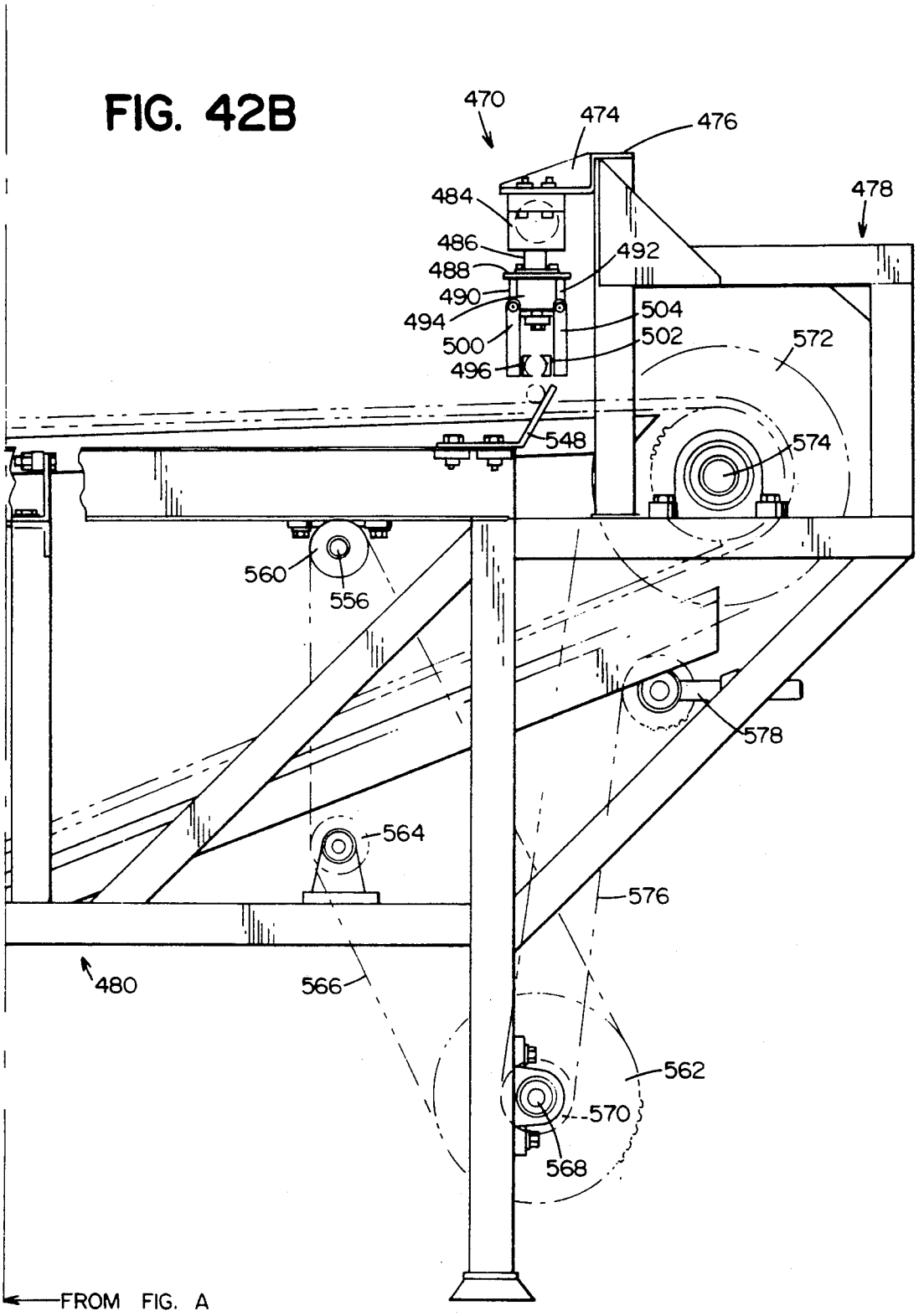
Figure 43:
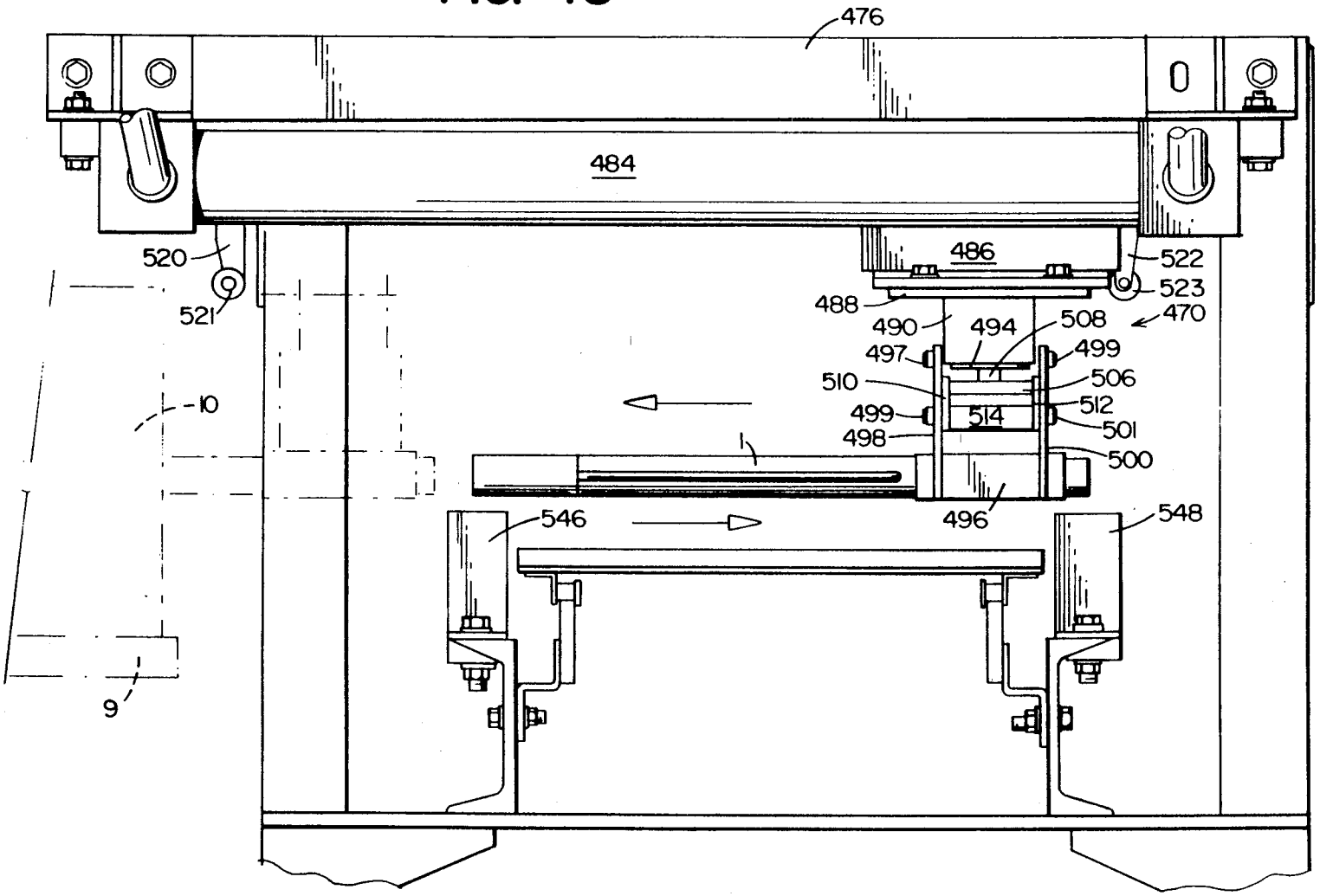
FIG. 43 is a detailed side view of the fusee discharge gripper assembly illustrated in FIG. 42B.

Turning to FIGS. 41 through 43, the fusee discharge gripper assembly and transfer conveyor will now be described in detail.

Adjacent the turntable 9 at station G, a discharge gripper assembly 470 is supported by a pair of brackets 472 and 474 which are mounted to a beam 476 of a box-like frame 478. This frame is supported on a larger framework 480 which supports the fusee transfer conveyor 23 and an off-loading pusher assembly 482. It will be understood that the supporting framework may be constructed in any suitable manner and need not be described in further detail, except insofar as particular component parts of the discharge gripper assembly and/or transfer conveyor components are directly supported thereby.

The discharge gripper assembly 470 includes a conventional rodless cylinder unit 484, for example, an Origa model P120 S/22 with a 40 mm bore and 15 ½ inch stroke. A mounting block 486 is slidably supported within the cylinder unit 484 for reciprocating movement with the piston (not shown) substantially the entire length of the cylinder.

The sliding block 486 supports a fusee gripper unit which is effective to pull assembled fusees and support stands, successively, from workpiece holders 10 on turntable 9 and to move them laterally to a position directly above a transfer conveyor, onto which they are released.

With particular reference to FIGS. 42B, 43 and 44, it may be seen that a pair of laterally spaced plates 490, 492 depend from a top plate 448 fixed to the block 486. Plate 488 further supports a pancake cylinder unit 494 which may be of the same type used to actuate the clamping inserts of the holder assemblies 10.

A first gripper 496 is pivotally connected via pins 497, 499 to the first plate 490 via a pair of laterally spaced, depending links 498, 500. A second gripper 502 is similarly pivotally connected to the second plate 492 via a pair of laterally spaced, depending links, only one of which is shown at 504.

At the same time, each of the upright links is connected to an actuator bar 506 attached to the piston 508 of the cylinder unit 494. Thus, with reference to FIGS. 43 and 44, it may be seen that a substantially U-shaped link including arms 510, 512 and connecting portion 514 is pivotally attached to upright links 498, 500 by pins 499, 501 at first ends of arms 510, 512, and to the actuator bar 506 at the other ends of arms 510, 512, also by pivot pins, only one of which is shown at 511.

A similar link assembly extends between the laterally spaced, depending links carrying second gripper arm 502 and the actuator bar 506.

In this manner, downward movement of actuator bar 506 causes grippers 496, 502 to swing outwardly to a release position as indicated in phantom in FIG. 44. Conversely, upward movement of the actuator bar 506 causes grippers 496 and 502 to swing toward each other to grip a fusee and support stand as described further hereinbelow.

With specific reference to FIG. 43, trip arms 520 and 522 provided with camming rollers 521, 523, respectively, are pivotally mounted at either end of the cylinder unit 484. Arms 520 and 522 are operatively connected to solenoids (not shown) which actuate the jaws to move between the above described gripping and releasing positions.

More specifically, engagement of roller 521 by block 486 as the gripper assembly moves to a position adjacent the turntable will cause the grippers 496, 502 to converge so as to grip a finished fusee projecting from a work holder 10. Upon closing of the gripper jaws, cylinder unit 484 is actuated by suitable means to cause the gripper assembly to move laterally away from the turntable, and to pull the assembled fusee and support stand from the holder assembly 10. When block 486 engages the roller 523, the pancake cylinder 494 is actuated to extend piston 508 and thereby separate the gripper arms 496, 504 to release the fusee onto the transfer conveyor 480. The cylinder unit 484 is then actuated to return to its position adjacent the turntable for removal of the next-indexed fusee and support stand.

Figure 41A:
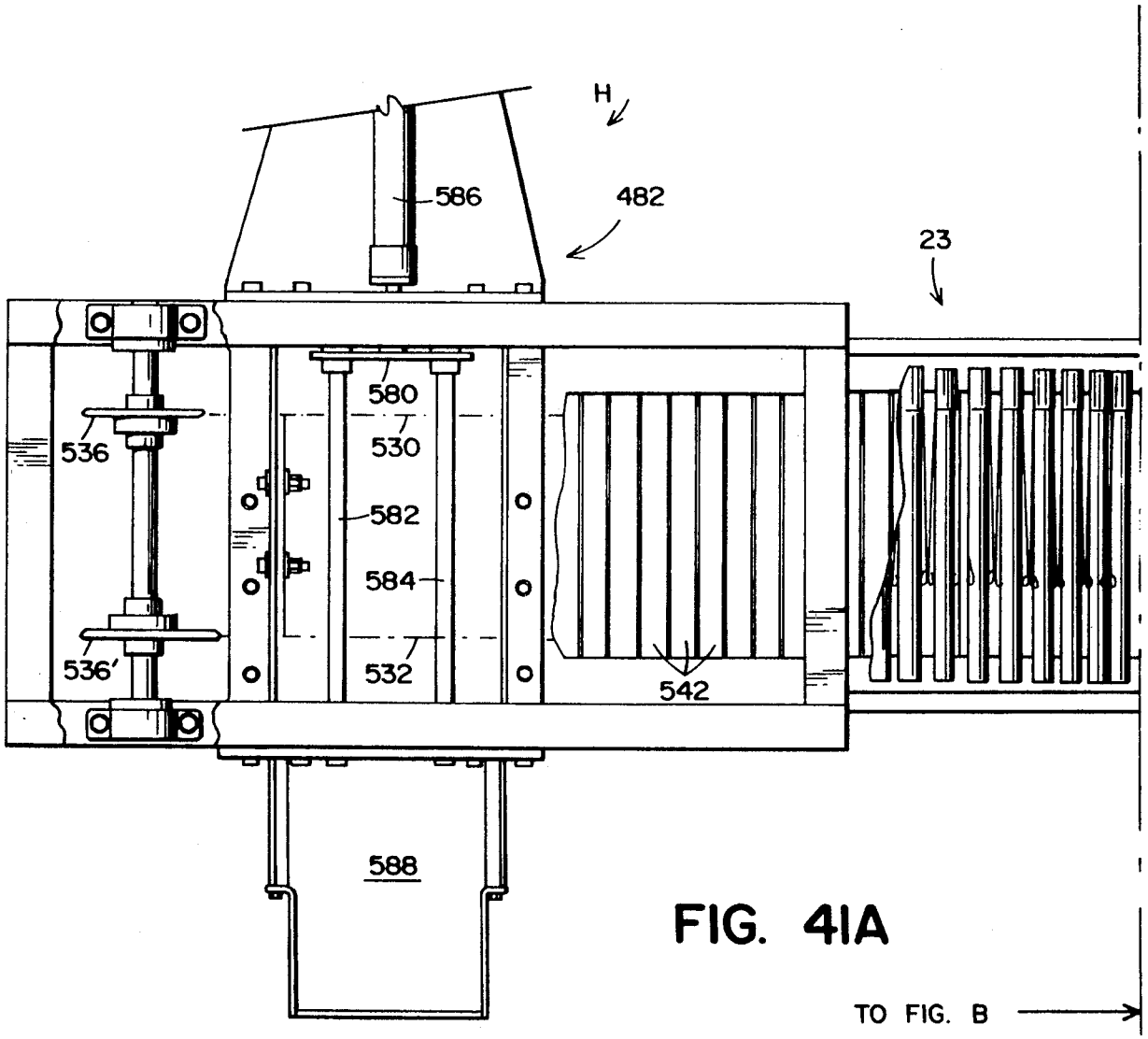
FIGS. 41A and 41B together constitute a top view of a fusee discharge device and off-loading conveyor in accordance with the subject invention.
Figure 41B:
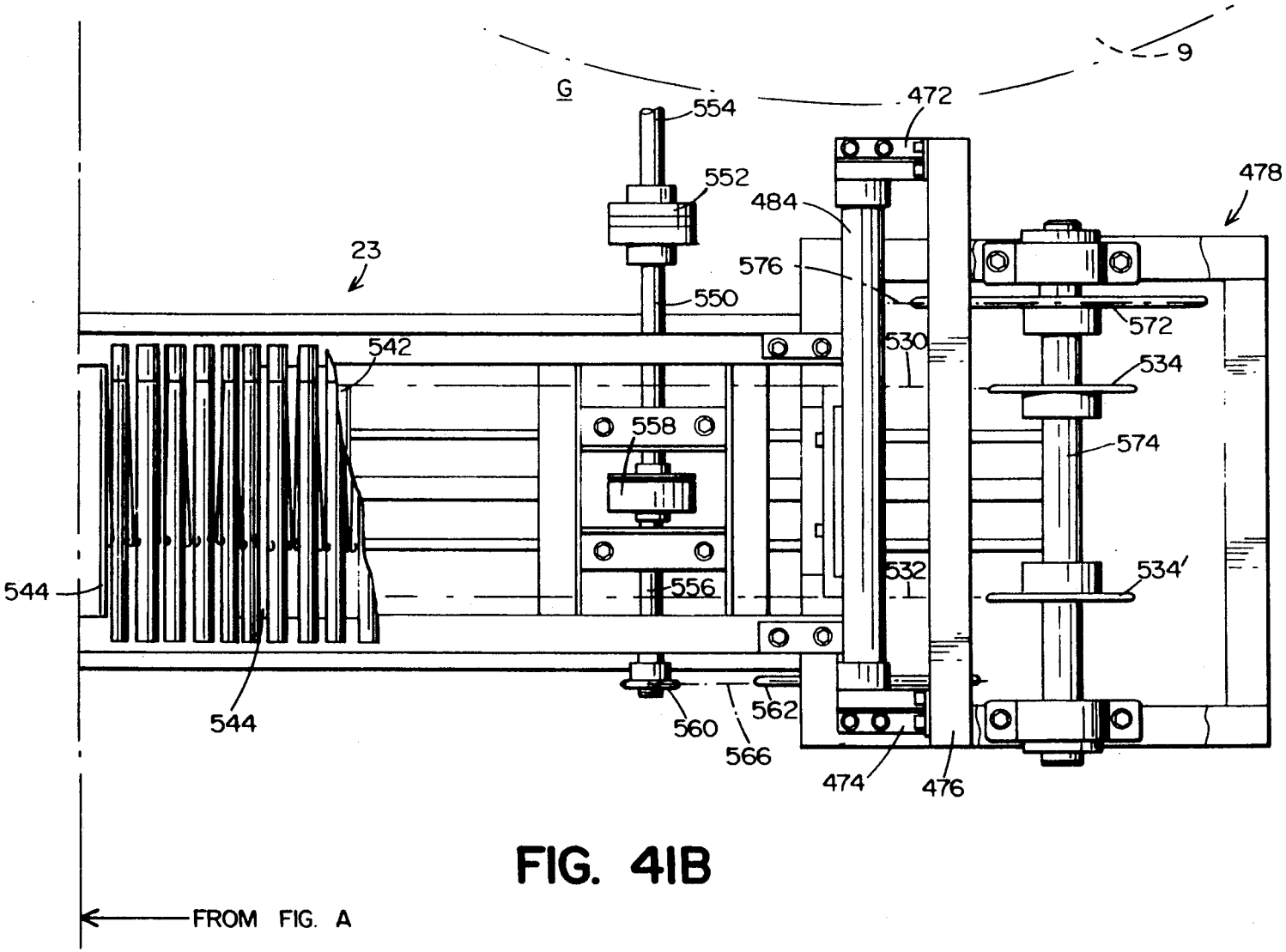

Referring to FIGS. 41A and B, and 42A and B, the transfer conveyor 23 extends generally between the discharge station G and a box loading station H. The conveyor includes a pair of chains 530 and 532 which travel in a path about laterally spaced sprocket pairs 534, 354', 536, 536', and additional sprocket pairs, one each of which is shown in FIG. 42A at 538, 540. Extending laterally between the chains are a series of metal flights 542 which, together form a substantially continuous conveying surface. Each flight has a width sufficient to receive an assembled fusee and support stand. As best seen in FIG. 41B, 42A and 44, every sixth flight is formed with a vertically extending flange 544. Accordingly, it will be understood that the conveyor is divided into sections configured to transfer fusees from the discharge station G to the box-loading station H, in groups of six, for example.

The conveyor is operatively connected to the main turntable drive for delayed intermittent movement. Specifically, the conveyor 23 remains stationary until the gripper arm assembly 470 loads six fusees onto the conveyor between adjacent vertical flanges 544. The conveyor is then indexed toward the box-loading station H until the next section of the conveyor is located beneath grippers 496, 502. Further in this regard, as the individual fusees are released from the grippers, they first contact inclined guide ramps 546, 548 which provide a lateral component of movement to the fusees as they descend toward the conveyor. In this way, it is assured that fusees will move forwardly as they are discharged to facilitate loading of six fusees between adjacent flanges 544.

Referring specifically to FIGS. 41B and 42B, it may be seen that shaft 550, extending transversely to the direction of conveyor movement, is coupled by a clutch 552 to the drive shaft 554 from the main turntable drive. Shaft 550 is axially coupled to a coaxially aligned shaft 556 through another coupling 558. The end of shaft 556 opposite the coupling 558 mounts a drive sprocket 560. Drive sprocket 560 is operatively connected to an intermediate sprocket 562 via idler 564 and a chain 566. Intermediate sprocket 562 is rotatably mounted on a shaft 568 extending transversely of the conveyor path, and parallel to shafts 550, 554 and 556. At the end of shaft 568 removed from sprocket 562, there is mounted a smaller sprocket 570 which is in a common vertical plane with the conveyor drive sprocket 572 mounted on shaft 574. A chain 576 connects sprockets 570 and 572.

Conveyor sprockets 534, 354' are also mounted on shaft 574, the rotational speed of which is determined by sprocket 572.

A conventional tension control device 578 is mounted to the supporting framework for controlling the tension in chain 576.

It will be understood that the relative diameters of the sprockets, in conjunction with clutch coupling 552, provide the desired length of travel for the successive intermittent movement of the conveyor, in timed relationship with the discharge of fusees onto the conveyor.

At the off-loading station H located at the downstream end of the conveyor 480, a pusher bar 580 is mounted for sliding movement along a pair of guide rods 582, 584 in a direction transverse to movement of the conveyor, and has a width which spans six flights of the conveyor. The pusher bar is operatively connected to a piston/cylinder unit 586 for reciprocatory movement across the conveyor. Actuation of the piston cylinder unit is achieved by solenoids (not shown) which operate in timed relationship with the intermittent movement of the conveyor. As each group of six fusees is indexed to the box-loading station H, the pusher bar 580 is actuated to move across the conveyor to push a group of six fusees off the conveyor and onto an inclined chute 588 which feeds the fusees into an appropriately positioned box 590, or similar container. It will be understood that by off-loading six finished fusees at a time, a complete layer is loaded into the appropriately sized box with each stroke of the pusher bar 580. The box itself is supported on another conveyor 592 which extends transversely of conveyor 480 and which transfers loaded boxes to a palletizer, or the like for shipping.

Figure 45:
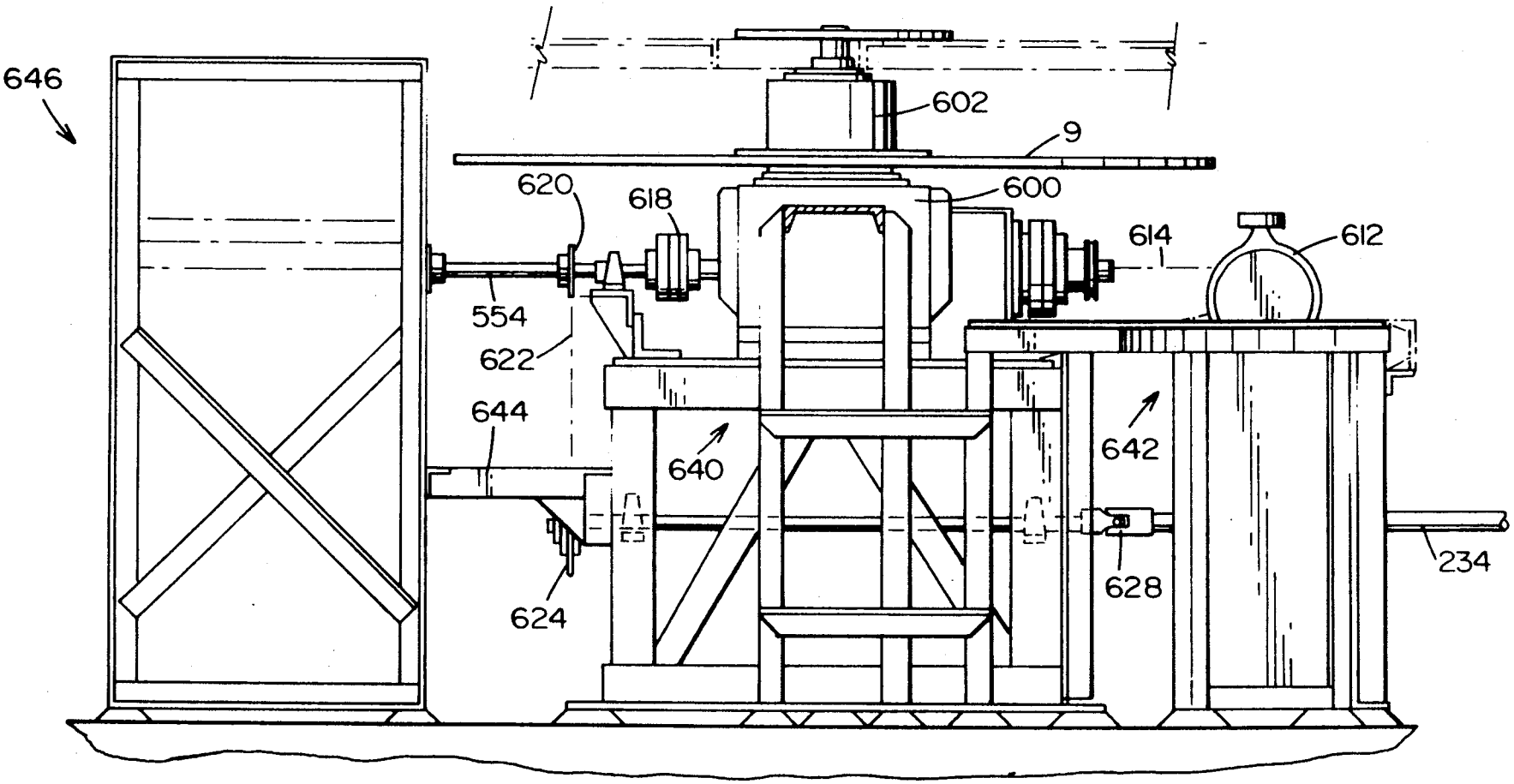
FIG. 45 is a side view of an annular turntable, associated drive means and supporting framework in accordance with the subject invention.
Figure 46:
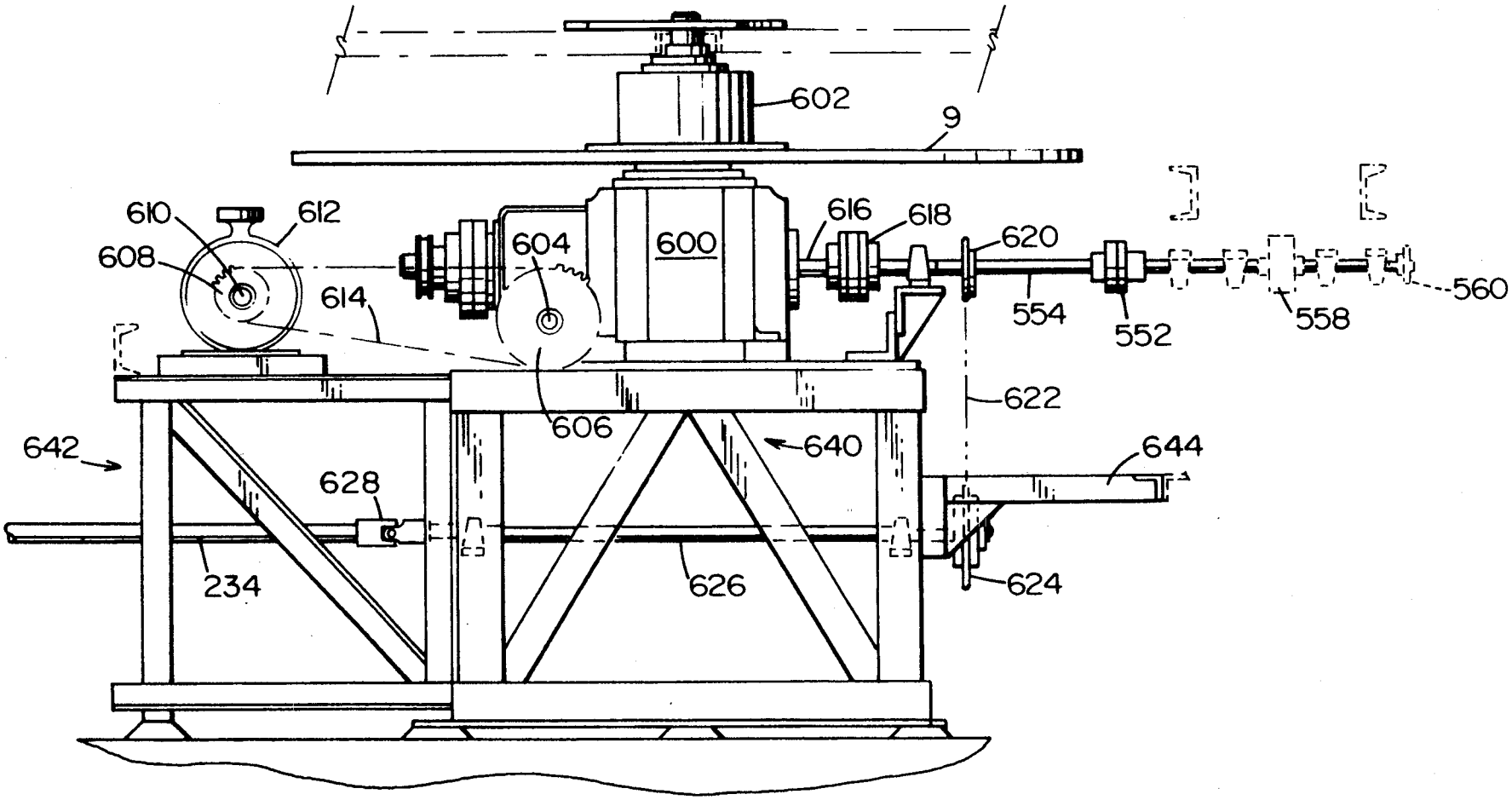
FIG. 46 is a side view of the apparatus illustrated in FIG. 45 and taken from the opposite side thereof.

With reference now to FIGS. 45 through 50, additional details will be disclosed with respect to the turntable 9. As illustrated in FIGS. 45 and 46, the turntable 9 is supported for rotation atop a conventional Ferguson drive intermittor 600. Specifically, the table is operatively connected to a first, vertically oriented output shaft (not shown) extending between the transmission unit and a hub 602 mounted atop the turntable. The transmission has an input shaft 604 mounting a gear 606 for operative engagement with a drive gear 608 mounted on the output shaft 610 of a main drive motor 612. Gears 606 and 608 are operatively connected by way of a drive chain 614.

A second output shaft 616 of the transmission extends horizontally toward the discharge conveyor 23 and is operatively coupled to the intermediate shaft 554 via coupling 618.

A gear 620 is mounted on the intermediate shaft 554 and mounts a chain 622 for connection between the gear 620 and a cooperating gear 624 mounted for rotation on a shaft 626 extending horizontally beneath the transmission and toward the infeed conveyor.

The shaft 626 extends to a U-joint coupling 628 which connects shaft 626 to coaxial shaft 234 which, in turn, extends to the U-joint coupling 232 at the input side of the Paradex drive P.

It will be appreciated that suitable supporting framework is provided for the turntable and its variously coupled drive units. The Ferguson transmission 600, for example, is supported on a box-like table or frame 640, while main drive motor 612 is supported on a laterally extending portion 642 of the main frame. A connector beam 644 interconnects the main framework to the discharge conveyor framework 646 for added stability and rigidity. While the drawings illustrate the frame structure is considerable detail, no specific discussion thereof is considered necessary, it being understood that this is a matter within the skill of the art.

Figure 48:
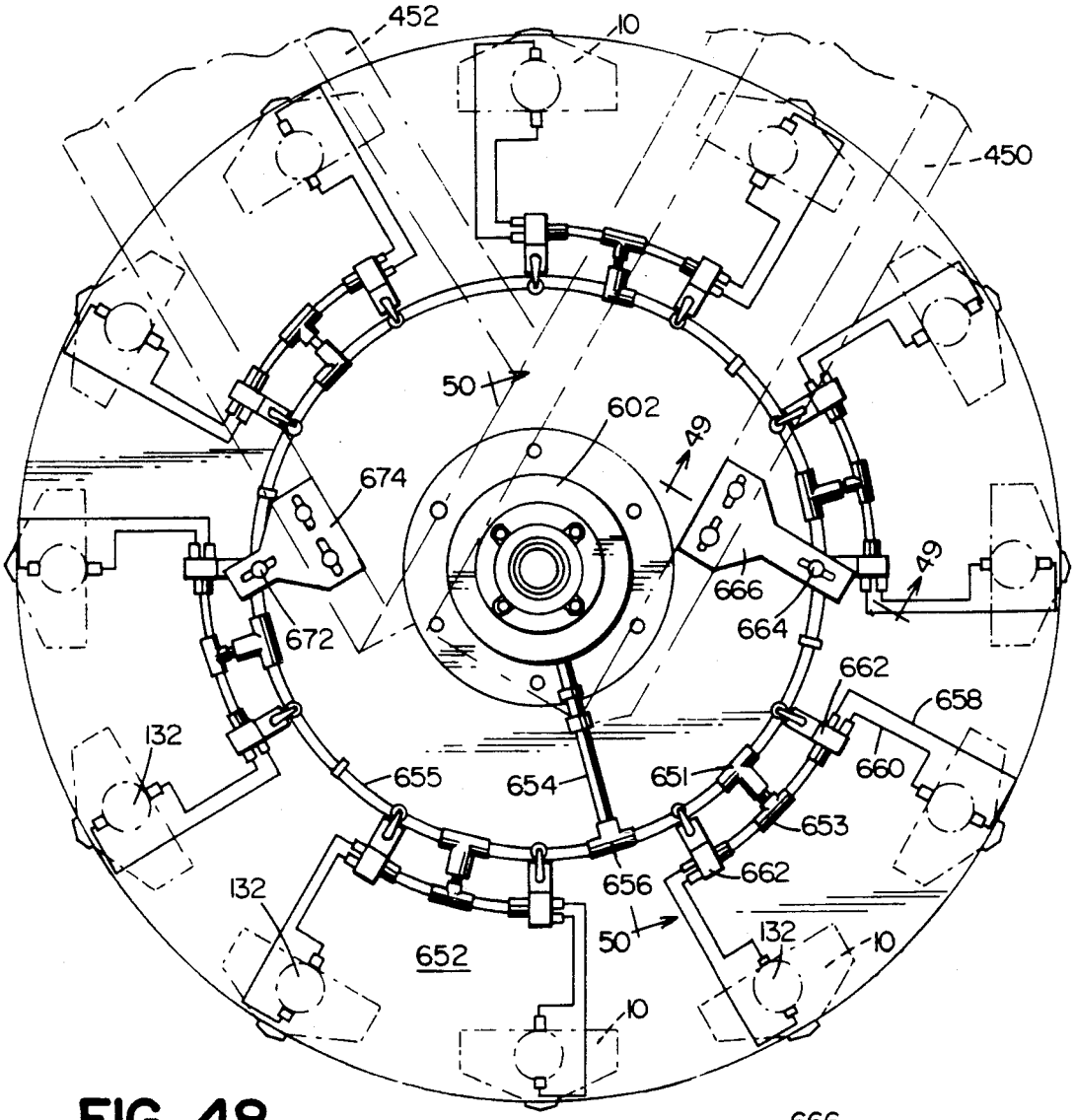
FIG. 48 is a partial top plan view of the annular turntable, illustrating pneumatic supply means for workpiece holder assemblies mounted on the table.
Figure 49:
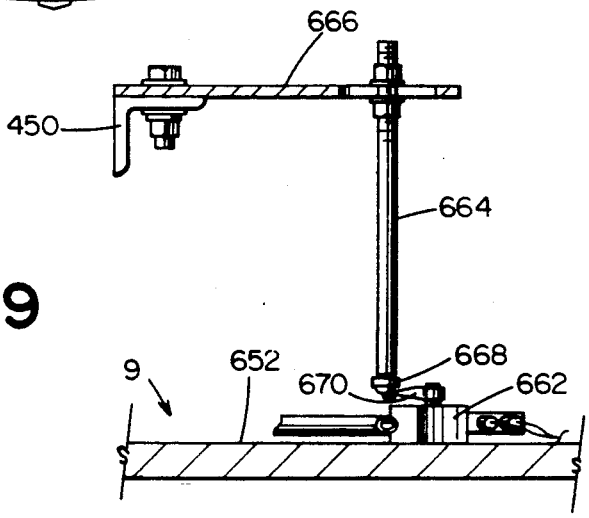
FIG. 49 is a side, cross-sectional view taken along the line 49—49 of FIG. 48.
Figure 50:
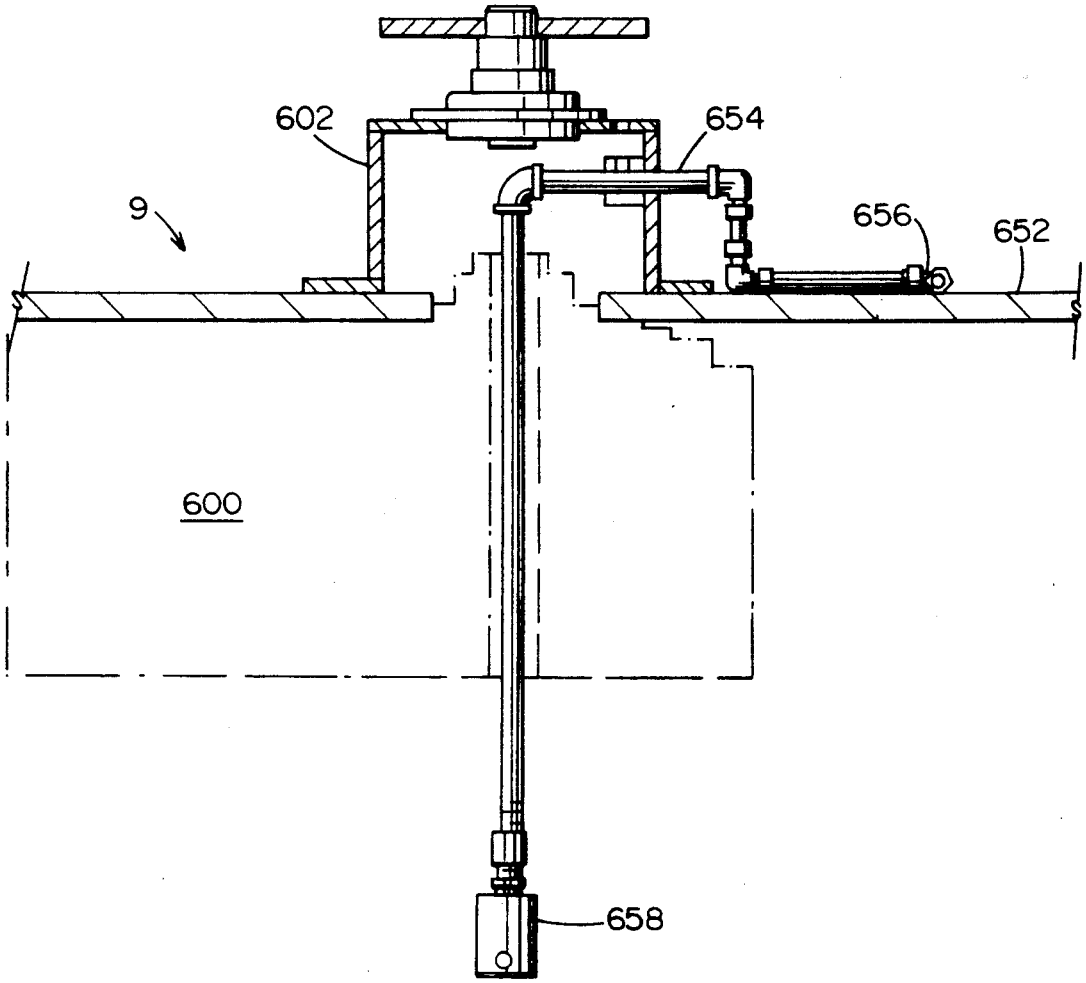
FIG. 50 is a partial, side, cross-sectional view of the annular turntable illustrating pneumatic supply means, and taken along the line 50—50 of FIG. 48.

Turning now to FIGS. 48, 49 and 50, there is illustrated the pneumatic supply and switching configuration for actuating and releasing the clamping inserts within the holder assemblies 10 upstream of tape applying station E and downstream of tape wrapping station F. Because the arrangement is the same for each holder assembly 10, only one such arrangement need be described in detail. A main supply conduit 654 is coupled to an annular manifold 655 at 656, and extends radially into the hub 602 and then vertically downwardly to an inlet port within a suitably mounted swivel joint 658.

Each holder assembly is provided with a supply line 658 and a discharge line 660 for admitting and discharging air to the pancake cylinder 132.

A solenoid operated valve 662 is provided for each holder assembly and is mounted between a T-joint coupling 653 and the holder 10 for controlling the supply and discharge of fluid to and from the cylinder 132.

The radial support frame 450, which mounts the tape applying apparatus 21, also mounts a trip arm 664 which depends vertically from a mounting bracket 666 attached to the radial frame 450. The arm is located within the path of travel of a roller cam 668 mounted on an arm 670 pivotally mounted to the solenoid operated valve 662. It will be understood that as the holder assembly 10 is indexed toward the tape applying station, the arm 664 will engage the roller cam 668, causing pivoting motion of the arm 670 which, in turn, causes the valve to open, admitting air to the pancake cylinder 132. This action causes extension of the piston 134 and consequent clamping action upon the fusee within the holder assembly as previously described. Thus, the fusee and support stand are firmly clamped in place for the tape applying operation at station 21.

As further shown in FIG. 47, a similar trip arm 672 depends from frame 452 by way of bracket 674. This switching arrangement is located downstream of the wrapper station 22 and functions to release the clamping inserts by retracting the pancake cylinder piston 134.

From the discussion above, it will be appreciated that the present invention permits the processing of a plurality of fusees, successively, through a number of workstations wherein:

(a) support stand wire is supplied, cut into predetermined lengths, and formed into substantially U-shaped configurations as they are loaded into successive holders on a turntable;

(b) fusees are supplied from a hopper, cleaned, and successively fed into assembled relationship with the support stands within the holders;

(c) assembled fusees and support stands are, successively, attached by a wrapping of polyfilament adhesive tape; and (d) completed fusee/support stand assemblies are successively removed from the holders, and transported in groups to be loaded into boxes for shipping.

Thus, the present invention provides a reliable fusee and wire support stand construction efficiently, and at higher rate of production, at reduced cost, in comparison to known fusee processing operations.

In addition, the utilization of a tight wrapping of polyfilament tape to secure the fusee to the support stand permits bending of the support stand legs to whatever angle is desired without failure of the tape.

While the present invention has been described in what is presently regarded to be its most practical embodiment, those of ordinary skill in the art would understand that many changes and modifications to the described method and apparatus may be made without departing from the spirit and scope of the claims which follow.

We claim:

1. A method of attaching a support stand to a fusee comprising the steps of:

(a) loading the support stand into a workpiece holding device;

(b) inserting the fusee into assembled relationship with the support stand within said workpiece holding device;

(c) applying fastening means to an end portion of said fusee;

(d) securing said fastening means about said end portion of said fusee and said support stand to form a complete fusee and support stand assembly; and (e) removing said assembly from said workpiece holding device.

2. A method as defined in claim 1 and including, during the practice of step (a), the step of simultaneously deforming said support stand from a substantially straight configuration to a substantially U-shaped configuration.

3. A method as defined in claim 1 wherein said substantially U-shaped support stand includes a pair of substantially parallel legs connected at one end by a base and wherein, during the practice of step (b), said base is engaged by an end face of said fusee.

4. A method as defined in claim 3 and including the further step of inwardly curling free end portions of said legs.

5. A method as defined in claim 4 wherein said fusee includes a forward ignition end and a rearward end, and wherein step (b) is practiced by inserting the rearward end of said fusee into engagement with said base of said support stand.

6. A method as defined in claim 5 wherein step (c) is practiced by applying a strip of polyfilament tape to said rearward end of said fusee and step (d) is practiced by wrapping said polyfilament adhesive tape about said rearward end portion of said fusee and portions of said support stand legs adjacent said base.

7. A method as defined in claim 6 and including the further step of cleaning said rearward end portion of said fusee prior to step (c).

8. A method of automatically attaching support stands to fusees comprising the steps of:

(a) moving a plurality of support stands, successively, to an assembly area;

(b) supplying a plurality of fusees, successively, to said assembly area;

(c) bringing said fusees and said support stands, successively and automatically, into assembled relationship; and (d) applying fastening means, successively and automatically to said assembled fusees and support stands.

9. A method as defined in claim 8 wherein, during the practice of step (c), the fusees and support stands are resiliently held in assembled relationship and wherein, prior to step (d), the fusees and support stand are fixedly clamped in said assembled relationship.

10. A method as defined in claim 8 and including, prior to step (a), the step of successively forming substantially straight lengths of wire into substantially U-shaped support stands.

11. A method as defined in claim 10 wherein said substantially U-shaped support stands include base portions interconnecting substantially parallel leg portions at first ends thereof, and including, prior to step (c) the further step of successively curling said substantially parallel leg portions at second ends thereof, remote from said base portions.

12. A method as defined in claim 11 and including, prior to step (c), the further step of successively cleaning end portions of said fusees which receive said fastening means during step (d).

13. A method as defined in claim 12 wherein step (d) is carried out by applying strips of adhesive tape, successively, to assembled fusees and support stands at said end portions, and by thereafter wrapping said strips of adhesive tape, successively, about said assembled fusees and support stands.

14. A method as defined in claim 13 wherein said strips of tape are about four inches long and about three inches wide.

15. A method as defined in claim 13 wherein said adhesive tape comprises polyfilament tape.

* * * * *